US009833042B1

(12) United States Patent
Hauser

(10) Patent No.: US 9,833,042 B1
(45) Date of Patent: Dec. 5, 2017

(54) CATCH MECHANISM FOR AN ELONGATED MEMBER

(71) Applicant: Matthew T. Hauser, Annapolis, MD (US)

(72) Inventor: Matthew T. Hauser, Annapolis, MD (US)

( * ) Notice: Subject to any disclaimer, the term of this patent is extended or adjusted under 35 U.S.C. 154(b) by 302 days.

(21) Appl. No.: 14/631,426

(22) Filed: Feb. 25, 2015

(51) Int. Cl.
*B25B 7/00* (2006.01)
*A43C 7/00* (2006.01)

(52) U.S. Cl.
CPC ..... *A43C 7/00* (2013.01)

(58) Field of Classification Search
CPC .... A43C 7/00; A43C 7/08; A43C 7/06; A43C 7/04; F16G 11/106; F16G 11/101; Y10T 24/3716; Y10T 24/3713; Y10T 24/3718; Y10T 24/3944; Y10T 24/3969; Y10T 24/3982; Y10T 24/3996; Y10T 24/3973
See application file for complete search history.

(56) References Cited

U.S. PATENT DOCUMENTS 1,149,385 A * 8/1915 Meyers ..... F16G 11/10 24/134 P
1,363,693 A * 12/1920 Swanson ..... A43C 7/00 24/712.6
1,959,722 A * 5/1934 Lackner ..... F16G 11/101 24/134 P
2,649,635 A * 8/1953 Peterson ..... F16G 11/101 24/134 R
2,911,697 A 11/1959 Henderson
3,354,518 A * 11/1967 Eugene ..... F16G 11/14 24/134 R
3,793,682 A * 2/1974 Nelson ..... B65G 39/145 198/828
4,336,636 A 6/1982 Ishiguro et al.
4,477,947 A 10/1984 Lyons
4,769,874 A 9/1988 Tracy
5,029,371 A 7/1991 Rosenblood et al.
5,323,514 A * 6/1994 Masuda ..... F16G 11/101 24/115 G
5,903,959 A 5/1999 Leonardi
6,185,798 B1 2/2001 Ton
6,718,602 B1 4/2004 Chang
6,779,281 B1 8/2004 Liu
6,817,070 B1 11/2004 Liu
6,839,944 B1 1/2005 Liu
7,124,482 B2 10/2006 Kim
7,387,272 B2 6/2008 Okot
(Continued)

FOREIGN PATENT DOCUMENTS

CN 21641688 Y 5/1994
DE 10041409 A1 3/2002
EP 1103198 A1 5/2001

*Primary Examiner* — Victor Batson
*Assistant Examiner* — Matthew Sullivan
(74) *Attorney, Agent, or Firm* — Coats & Bennett, PLLC

(57) ABSTRACT

A catch for attachment to an elongated member and to control movement of the elongated member. The catch generally includes a body with one or more channels, a locking member positioned in the body in proximity to the channel, and a release member to control an extent of movement of the locking member. The catch provides for attachment to the elongated member to adjust its length. The catch is adjustable to provide for movement of the elongated member through the channel.

17 Claims, 29 Drawing Sheets

(56) References Cited

U.S. PATENT DOCUMENTS

| | | | | |
|---|---|---|---|---|
| 7,574,786 | B2 | 8/2009 | Cheng | |
| 2008/0115334 | A1 | 5/2008 | Chen et al. | |
| 2011/0067211 | A1 | 3/2011 | Huber et al. | |
| 2012/0017400 | A1* | 1/2012 | Ussher | F16G 11/106 24/136 L |
| 2015/0272277 | A1* | 10/2015 | Munsell | A43C 7/08 24/712.6 |

* cited by examiner

CATCH MECHANISM FOR AN ELONGATED MEMBER

BACKGROUND

The present application is directed to a catch for adjusting an elongated member and, more specifically, a catch that is adjustable between locked and unlocked positions to selectively adjust the length of an elongated member.

Elongated members are used in a variety of different applications and on a variety of different objects. Examples include drawstrings used with clothing items, such as around a hood of a sweatshirt (i.e., a "hoodie" sweatshirt), around the waist of shorts such as running shorts or swimming suits, and around the waist of pants such as sweatpants. Another example is for use with storage containers, such as a bag for holding sand, rice, small objects, etc. Another use is for luggage, such as a duffel bag, backpack, lunch bag, etc. These are but a few examples of the many different diverse uses for a drawstring.

The elongated members may be tied into knots to adjust their length. However, knots are often difficult to untie. Further, some elongated members (e.g., chain) are not able to be tied into a knot.

To effectively adjust the length, a catch may be used with the elongated members. The catch should allow for the elongated member to be adjusted to the needed length. For example, the elongated member can have a longer effective length when the object to which it is attached is in an open or expanded configuration. The elongated member can also have a shorter effective length when the object is closed or secured. The catch should allow the effective length of the member to be adjusted accordingly depending upon whether a user wants the object in an open or closed configuration.

Some catch mechanisms are problematic because they do not secure the elongated member at the desired length. The catch should prevent slippage of the member once placed in a locked orientation to maintain the object in the desired configuration. Further, catch mechanisms are often over-complicated and/or non-intuitive to use. The catch mechanisms are difficult to use by someone who is not familiar with the device. Further, some catch mechanisms are difficult to determine whether they are in a locked or unlocked configuration. Users often become frustrated, particularly when using it for the first time.

SUMMARY

The present application is directed to an auto-setting catch that connects to one or more elongated members in order to control movement of the one or more elongated members relative to the catch. If the catch connects to more than one elongated member, it can be designed to control movement of the elongated members relative to one another as well as relative to the catch. The elongated members may be flexible (examples include, but are not limited to, strings, cords, ropes, cables, chains, and belts) or rigid (examples include, but are not limited to, pipes, rods, poles, beams, and tracks). The elongated members may also be open-ended or closed-loop.

The catch is designed to allow movement of an elongated member in a first direction and to either allow or limit movement of an elongated member in a second direction based on the operational state of the catch. If the catch is designed to connect to more than one elongated member, it can be designed such that the first and second directions of movement for each elongated member are the same or it can be designed such that the first and second directions of movement for each elongated member are different. The catch may also be designed such that the first and second directions of movement for each elongated member are in any combination of being the same or different.

The catch includes one or more locking members, one or more release members, and a structure to maintain the proper relationships between the members. The catch is designed such that locking members contact elongated members and generally move together with elongated members between the two extreme positions of the locking members. When locking members are at their extreme position in the first direction of movement of the elongated members, elongated members may move past locking members in the first direction of movement of the elongated members. Likewise, when locking members are at their extreme position in the second direction of movement of the elongated members, elongated members may move past locking members in the second direction of movement of the elongated members.

The catch is designed such that release members are moveable between two positions, the non-blocking position and the blocking position. The catch is also designed such that release members are biased toward the blocking position. This biasing is accomplished by some means of generating force (examples include, but are not limited to, elastically deformable materials, magnets, pressurized gases, and gravity). When release members are in their non-blocking position, locking members are free to move to their extreme position in the second direction of movement of the elongated members. When locking members are in their extreme position in the second direction of movement of the elongated members, locking members maintain the release members in their non-blocking position. When locking members are moved back a sufficient amount in the first direction of movement of the elongated members, release members are once again free to move to the blocking position as they are biased to do. When release members are in their blocking position, locking members are prevented from moving to their extreme position in the second direction of movement of the elongated members.

When movement of locking members in the second direction of movement of the elongated members is thus prevented, movement of elongated members in their second direction is also prevented, unless the opposing forces (on elongated members and locking members that would move elongated members in their second direction) exceed design limits.

One embodiment is directed to a method of controlling movement of an elongated member through a catch. The method includes moving the elongated member through the catch along a channel in a first direction while a locking member that is in contact with the elongated member is maintained in a first orientation. With the locking member in the first orientation and in contact with the elongated member, moving the elongated member in an opposing second direction through the catch and simultaneously moving the locking member with the elongated member to a second orientation. With the locking member in the second orientation, blocking the locking member with a release member that is in a first position and preventing the elongated member from moving along the channel in the second direction. The method also includes with the locking member in the second orientation, moving the release member to a second position and moving the elongated member along the channel in the second direction and simultaneously moving the locking member that is in contact with the elongated member to a third orientation. With the locking member in the third orientation, moving the elongated member farther along the channel in the second direction. With the locking member in the third orientation, moving the elongated member in the first direction and simultaneously moving the locking member that is in contact with the elongated member to the first orientation.

The method may also include contacting the locking member against a contact surface in the first orientation and preventing the locking member from moving farther along the channel in the first direction.

The method may also include moving the locking member over the release member while the release member is in the second position while moving the locking member from the second orientation to the third orientation.

The method may also include maintaining the locking member over the release member and preventing the release member from returning to the first position while the locking member is in the third orientation.

The method may also include contacting the locking member against a contact surface in the third orientation and preventing the locking member from moving farther along the channel in the second direction.

One embodiment is directed to a catch for controlling movement of an elongated member. The catch includes a body with an interior space with a floor and a recess that extends below the floor. A channel extends through the interior space along the floor and includes a first side formed at least in part by a contact sidewall. A locking member is movably positioned in the interior space of the body. The locking member includes a contact section that extends into the channel and a blocking section positioned away from the contact section. A release member is mounted in the body at the recess. A biasing member biases the release member towards a first position. The locking member is movably positioned in the interior space between a first orientation with the blocking section spaced away from the release member, a second orientation with the blocking section of the locking member in proximity to the release member, and a third orientation with the blocking section positioned beyond the release member. The contact section of the locking member is in closer proximity to the contact sidewall in the second orientation than in either the first orientation or the third orientation.

The release member may include a stepped configuration with a first step and a second step with each of the first and second steps being positioned above the floor with the locking member in each of the first and second orientations, and the first step positioned below the floor with the locking member in the third orientation.

The locking member may include a triangular shape with the contact section comprising a tip.

The catch may also include a contact edge positioned in the interior space above the floor with the locking member being in contact with the contact edge and moving along the contact edge when moving between the first, second, and third orientations.

The catch may also include a post that extends upward beyond the floor of the interior space with the post positioned in proximity to the locking member to contact with the locking member in the first orientation and control an extent of movement of the locking member.

The channel may be straight.

The channel may be curved.

Another embodiment is directed to a catch for controlling movement of an elongated member. The catch includes a body with a top and a bottom with the body including an interior space formed between the top and bottom with the interior space including a floor. A channel extends through the body along the floor of the interior space. A first side of the channel is formed at least in part by a contact sidewall. A travel path extends along the floor of the interior space in proximity to the channel and includes a first end and an opposing second end. A locking member is positioned in the interior space at the travel path. The locking member includes a contact section and is movable within the body along the travel path between the first and second ends. A release member is mounted in the body at the second end of the travel path. The release member includes a first section with a first height and a second section with a greater second height. The locking member is movable along the channel and opposite from the contact sidewall between a first orientation at the first end of the travel path with the contact section spaced a first distance away from the contact sidewall, a second orientation at the second end of the travel path with the contact section spaced a smaller second distance away from the contact sidewall, and a third orientation beyond the second end of the travel path and positioned over the first section of the release member. The third orientation includes the contact section positioned a third distance away from the contact sidewall that is greater than the second distance.

The travel path may include a curved shape and may be formed along a contact edge that extends upward beyond the floor of the body.

The release member may include a curved surface that is positioned at the second end of the travel path, and the locking member may move along the curved surface when moving from the second orientation to the third orientation.

The locking member may include a curved contact side with a shape that matches the curved shape of the travel path.

The locking member may include an elongated straight shape with a first end forming the contact section to contact against the elongated member and an opposing second end that faces away from the elongated member.

The locking member may be pivotally mounted to the body.

A biasing member may bias the release member towards a blocking position.

Another embodiment is directed to a method of controlling the movement of an elongated member in first and second directions through a catch. The method includes: moving the elongated member in the first direction through a channel in the catch; while the elongated member is moving along the channel in the first direction, moving a locking member that is in contact with the elongated member to a first orientation against a post with the locking member in the first orientation being spaced away from a contact sidewall of the channel to allow further movement of the elongated member in the first direction; moving the elongated member in an opposing second direction along the channel; while the elongated member is moving along the channel in the second direction, moving the locking member that remains in contact with the elongated member away from the post to a second orientation against a release member with the locking member in the second orientation being spaced a closer distance to the contact sidewall of the channel than in the first orientation and preventing additional movement of the elongated member along the channel in the second direction; moving the release member away from the locking member and continuing to move the elongated member in the second direction along the channel; while the elongated member is continuing to move in the second direction along the channel, moving the locking member that remains in contact with the elongated member to a third orientation with the locking member in the third orientation being farther away from the contact sidewall of the channel than in the second orientation to allow additional movement of the elongated member along the channel in the second direction. The locking member remains in contact with the elongated member in each of the first, second, and third orientations.

Moving the release member may include moving a first section of the release member below a level of the locking member and moving the locking member to a third orientation over the first section of the release member.

Moving the locking member between the first and second orientations may include moving the locking member along a curved contact edge with the first orientation including the locking member at a first end of the curved contact edge and the second orientation including the locking member at a second end of the curved contact edge.

Moving the locking member may include pivoting the locking member.

The various aspects of the various embodiments may be used alone or in any combination, as is desired.

BRIEF DESCRIPTION OF THE DRAWINGS

FIG. 8 is a perspective view of an interior of the catch of FIG. 6 with the catch in a first orientation.

DETAILED DESCRIPTION

The present application is directed to catches configured to control the movement of one or more elongated members. Each catch includes one or more channels each sized to receive an elongated member. The catch is positionable in a variety of orientations to selectively control the movement of the one or more elongated members relative to the catch.

Figure 1:
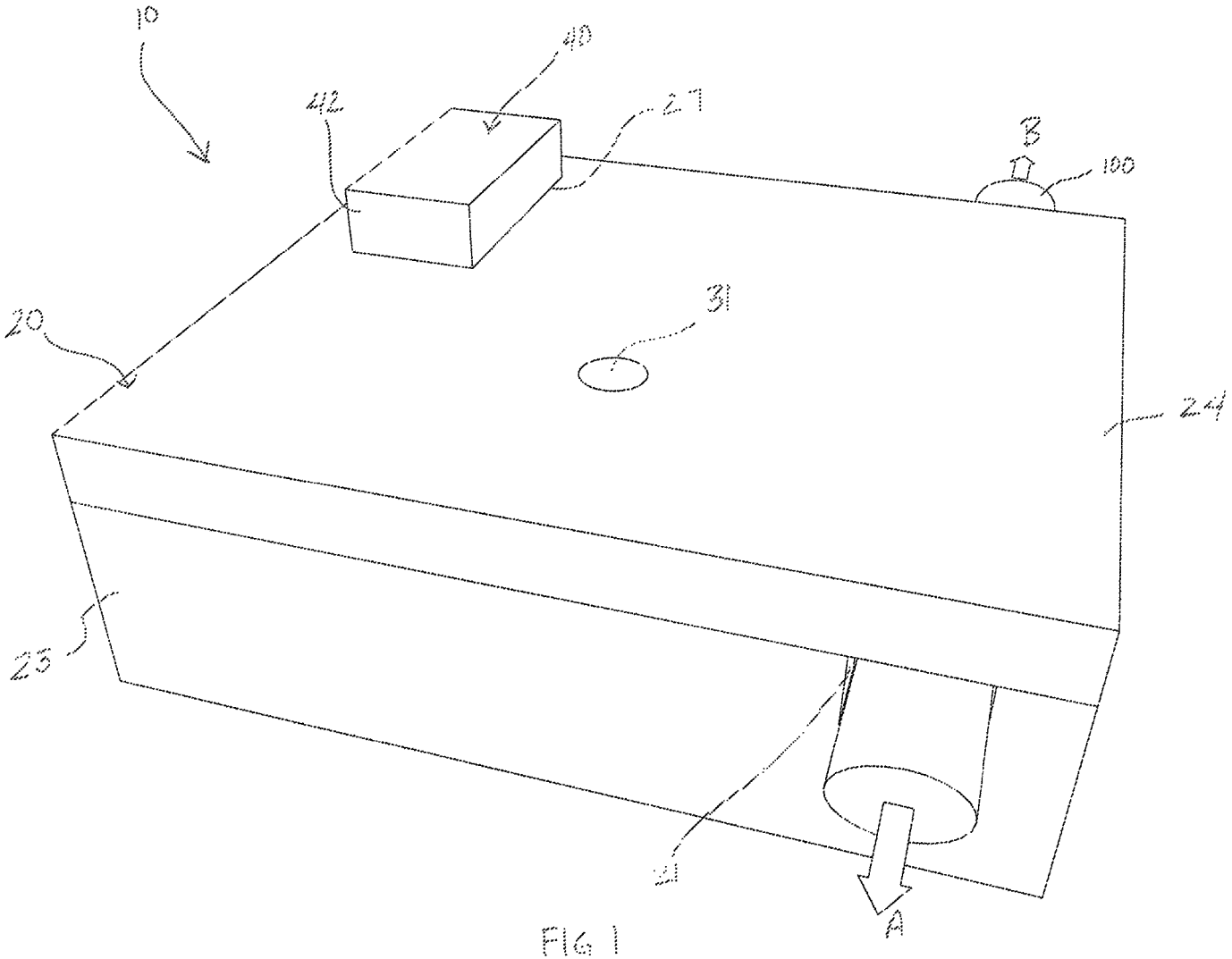
FIG. 1 is a perspective view of an elongated member extending through a catch.
Figure 2:
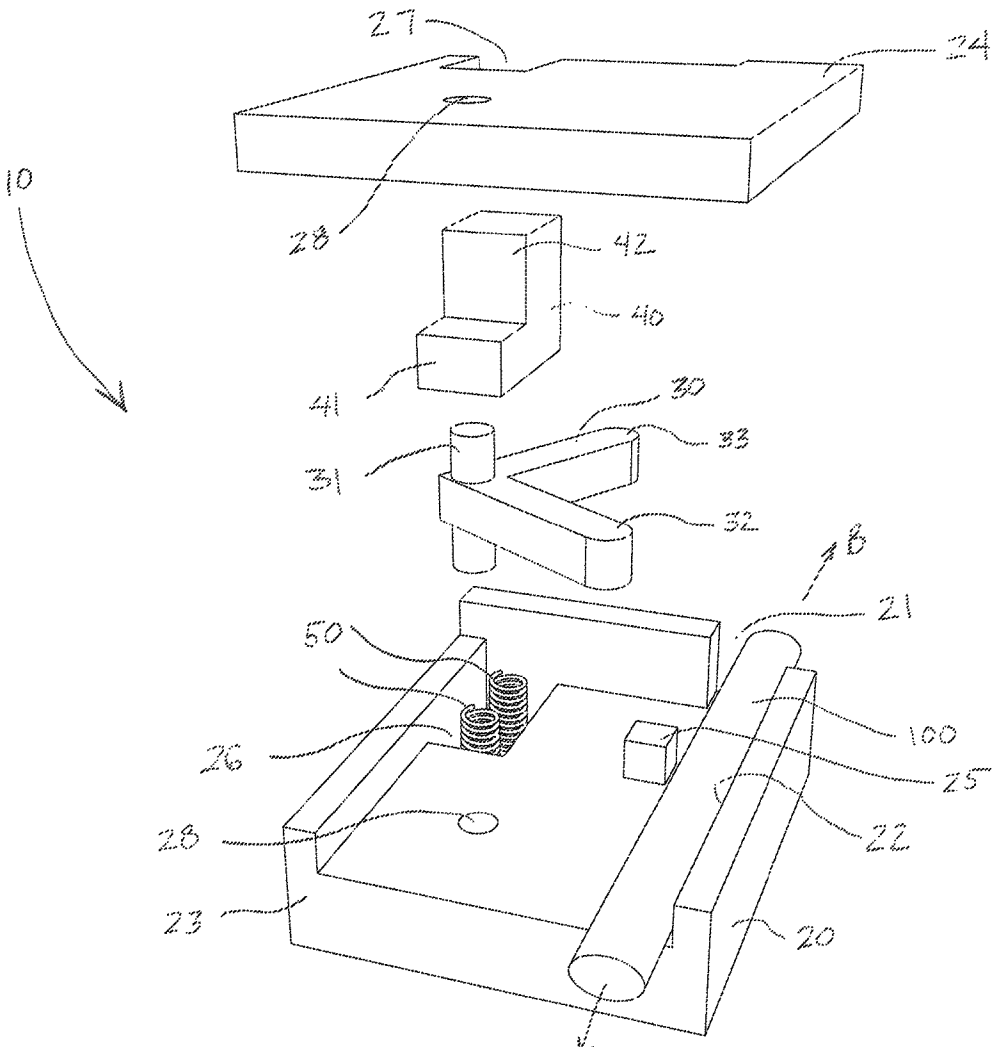
FIG. 2 is an exploded perspective view of the catch of FIG. 1.

FIGS. 1 and 2 illustrate a catch 10 configured to control the movement of an elongated member 100. The catch 10 includes a body 20 with a channel 21 to receive the elongated member 100, a locking member 30, and a release member 40. Each of the locking member 30 and the release member 40 are movable between various positions to control the movement of the elongated member 100.

The body 20 forms the channel 21 for receiving the elongated member 100. The channel 21 includes at least one contact sidewall 22 along one side opposite from the locking member 30. In the embodiment of FIG. 2, the contact sidewall 22 is formed by the inner surface of a sidewall. The channel 21 may have various shapes and dimensions, including straight (as illustrated in FIG. 2), curved, etc. FIGS. 1 and 2 include the body 20 with a single channel 21 to receive a single elongated member 100, although other embodiments may include multiple channels 21.

The body 20 includes a bottom section 23 and a top section 24. The sections 23, 24 may be permanently attached together, or may be removably attached together to provide access to the interior space. A post 25 extends from the floor of the bottom section 23 and is positioned in proximity to the locking member 30. The post 25 may have a variety of shapes and sizes to engage with the locking member 30 as will be explained in detail below. The bottom section 23 may also include a recess 26 that receives the release member 40 and one or more biasing members 50. The top section 24 may include a cut-out 27 through which a portion of the release member 40 extends for contact by the user.

The locking member 30 is movably positioned in the body 20. Locking member 30 may include a post 31 that extends through openings 28 in the bottom and top sections 23, 24. Locking member 30 also includes first and second arms 32, 33. The arms 32, 33 may include the same shape and size as illustrated in FIG. 2, or may include different shapes and/or sizes. In one embodiment, the arms 32, 33 are spaced apart by about 90°, although other embodiments may position the arms 32, 33 at other orientations. In one embodiment, the locking member 30 includes a single arm.

The release member 40 is also movably positioned in the body 20.

Release member 40 includes a first section 41 that contacts against the locking member 30 and a second section 42 for contact by the user. As illustrated in FIG. 1, the second section 42 extends through the cut-out section 27 in the top section 24 of the body 20 for contacting by the user. In one embodiment, as illustrated in FIG. 2, the release member 40 includes a stepped configuration with the first section 41 forming a first step and the second section 42 forming a second step.

Each biasing member 50 is positioned between a bottom of the recess 26 and the release member 40. The number of members 50 may vary depending upon the context. The members bias the release member 40 upward away from the recess 26 towards the top section 24 of the body 20. Biasing members 50 may include various structures, including but not limited to springs and an elastic material such as foam.

The catch 10 is configured to control the movement of the elongated member 100 along the channel 21. The catch 10 is configured to provide for the elongated member 100 to move in opposing directions (indicated by arrows A and B) along the channel 21. The catch 10 is configured for the elongated member 100 to be movable in the first direction (indicated by arrow A), but to selectively limit the movement in the second direction (indicated by arrow B). The control in the second direction is based on the relative positioning of the release member 40 and locking member 30.

Figure 3:
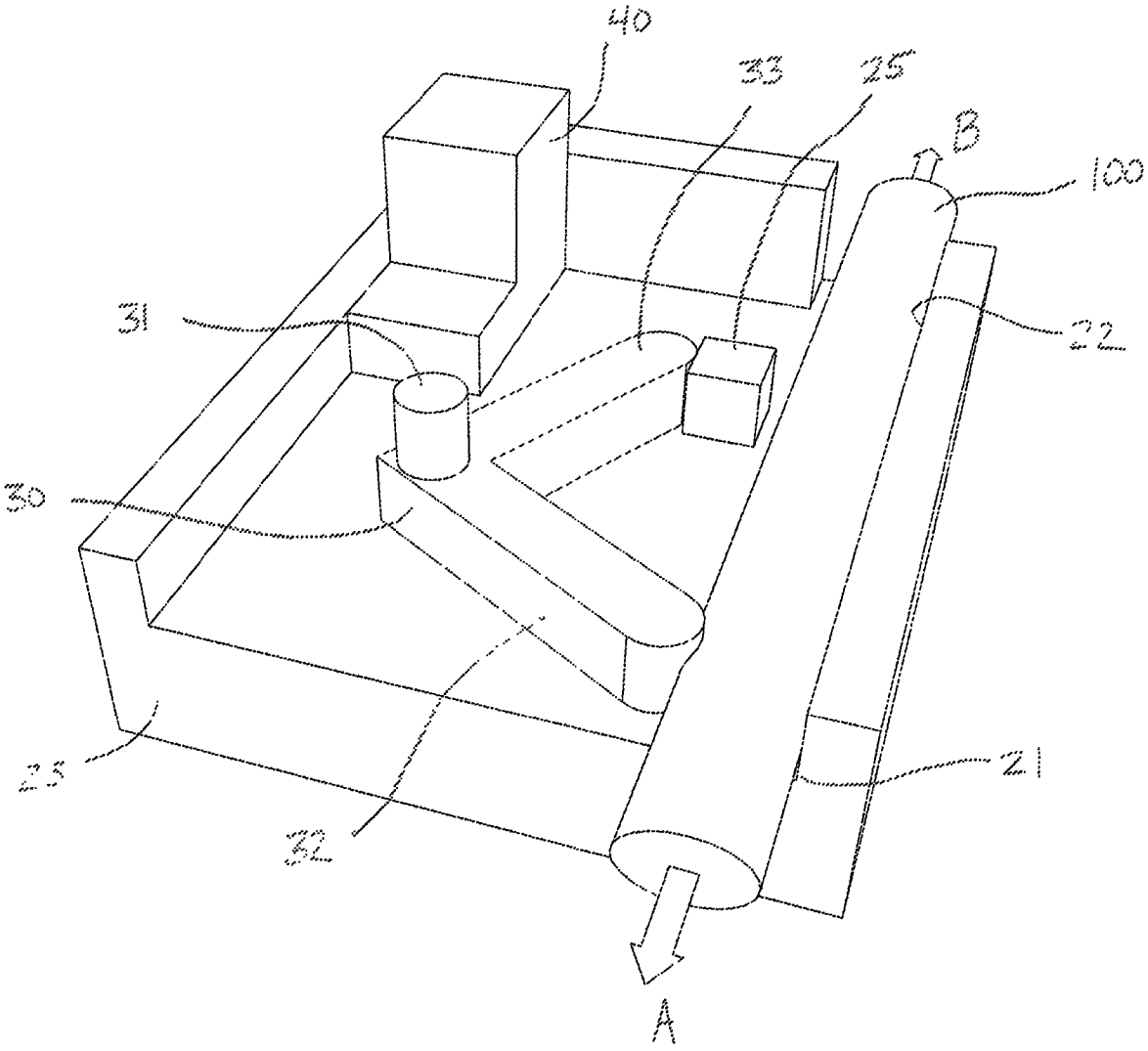
FIG. 3 is a perspective view of an interior of the catch of FIG. 1 with the catch in a first orientation.

FIG. 3 illustrates the catch 10 in a first orientation (the top section 24 is removed for clarity into the interior of the catch 10). As illustrated, the first arm 32 of the locking member 30 is positioned against the elongated member 100 and the second arm 33 is positioned between the post 25 and the release member 40. A force is being applied to the member 100 to move the member 100 in the first direction indicated by arrow A. The second arm 33 is in contact with the post 25 to limit the extent of pivoting movement of the locking member 30. The end of the first arm 32 is positioned a distance away from the contact sidewall 22 for the member 100 to slide along the channel 21 in the direction of arrow A. The first arm 32 is in contact with the member 100, but not to an extent to prevent movement in the first direction A.

When the elongated member 100 is pulled in the opposing second direction, the contact between the arm 32 and the elongated member 100 pivots the locking member 30 in an opposing direction. The elongated member 100 moves in the second direction B until the second arm 33 moves against the side of the locking member 40. Specifically, the second arm 33 contacts against the sidewall of the locking member 40 and the first arm 32 is in closer proximity to the contact sidewall 22 of the channel 21. The elongated member 100 is squeezed between the arm 32 and the contact sidewall 22 preventing movement in the second direction. The end of the first arm 32 is closer to the contact sidewall 22 in the second orientation than the first orientation.

Figure 4:
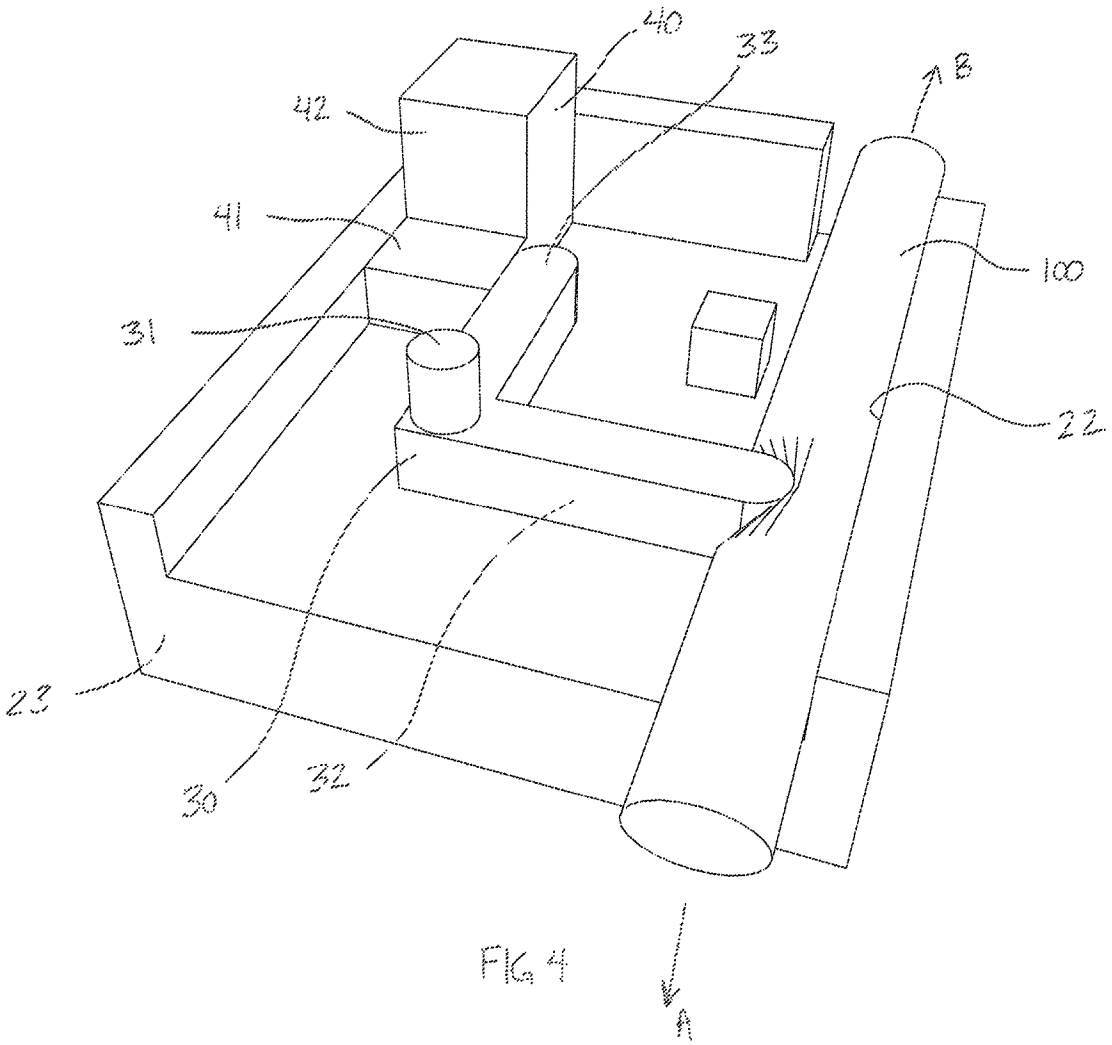
FIG. 4 is a perspective view of an interior of the catch of FIG. 1 with the catch in a second orientation.

FIG. 4 illustrates the catch 10 in this second orientation that prevents movement of the elongated member 100 in the second direction (i.e., in the direction indicated by arrow B). The end of the arm 32 may be configured to facilitate the contact. FIG. 4 includes the end having a tapered shape that facilitates contact with and deformation of the elongated member 100. The end of the arm 32 may also have other shapes, including but not limited to a pointed end.

The extent of pivoting movement of the locking member 30 is limited by the second arm 33 contacting against the release member 40. In this orientation, the first section 41 of the release member 40 extends above the floor of the bottom section 23. This positioning causes the second arm 33 to contact the first section 41 and prevent further movement of the locking member 30 in the second direction. In one embodiment as illustrated in FIG. 4, the lateral edge of the arm 33 and the edge of the first section 41 are both flat to facilitate solid contact between these elements in this second orientation. In the second orientation, the elongated member 100 can be moved in the first direction as the contact between the first arm 32 and the elongated member 100 causes the locking member 30 to pivot back towards the first orientation.

Figure 5:
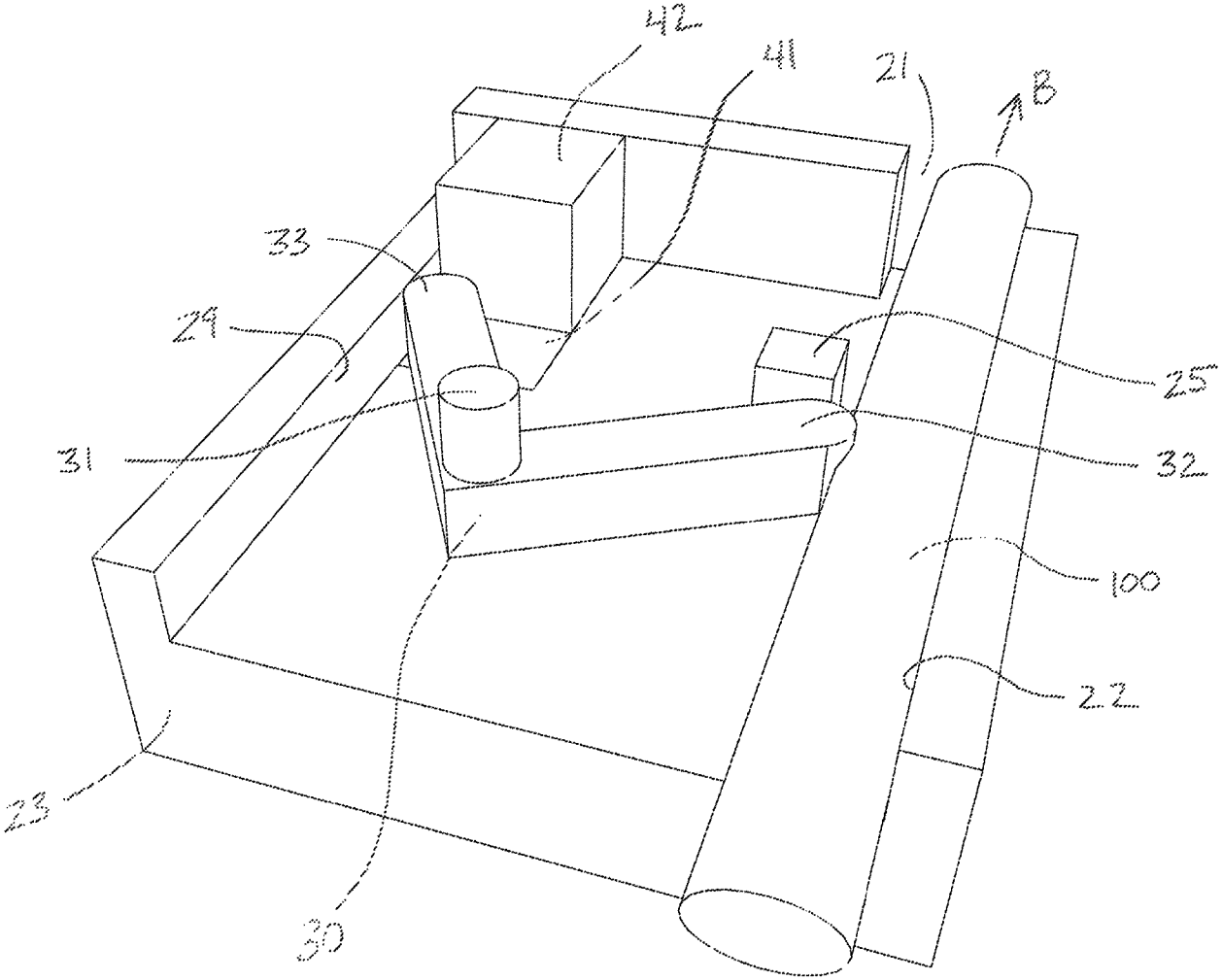
FIG. 5 is a perspective view of an interior of the catch of FIG. 1 with the catch in a third orientation.

FIG. 5 illustrates the catch 10 in a third orientation to provide continued movement of the elongated member 100 in the second direction B. The locking member 30 moves from the second orientation (FIG. 4) to the third orientation (FIG. 5) by the release member 40 being depressed by the user. This force applied by the user causes the release member 40 to move downward into the recess 26 in the bottom section 23 of the body 20. This causes the first section 41 to move downward such that a top surface is recessed below or flush with the floor of the bottom section 23. This positioning allows for the locking member 30 to further pivot and for the second arm 33 to pivot over the top of the first section 41. The extent of pivoting movement of the locking member 30 may be limited by the second arm 33 contacting the sidewall 29 of the body 20 and/or the first arm 32 contacting the post 25. In this third orientation, the end of the arm 32 is distanced a greater distance away from the contact sidewall 22 thus allowing for movement of the member 100 in the second direction B. In the third orientation, the elongated member 100 can be moved in the first direction as the contact between the first arm 32 and the elongated member 100 causes the locking member 30 to pivot back towards the first orientation.

In each of the three orientations, the locking member 30 remains in contact with the elongated member 100. This contact provides for the force for moving the locking member 30 between the various orientations. This includes moving from the first orientation to the second orientation, and the second orientation to the third orientation. This contact also provides for moving the locking member 30 from the third orientation back to the first orientation.

The release member 40 is maintained in the depressed position when the second arm 33 of the locking member 30 is positioned over the first section 41. Specifically, the bottom side of the second arm 33 contacts against the floor of the bottom section 23 and/or the top of the first section 41. The top side of the locking member 30 contacts against the underside of the top section 24 of the body 20. A thickness of the arm 33 (measured between the top and bottom sides) prevents the release member 40 from moving upward relative to the body 20. The force of the one or more biasing members 50 may further cause the locking member 30 to remain in this third orientation. Movement of the elongated member 100 in the first direction A causes the locking member 30 to pivot and the second arm 33 to move off of the first section 41. Once removed, the release member 40 moves upward to the non-depressed position (as illustrated in FIGS. 3 and 4). Thus movement from the third orientation to the first orientation can be accomplished by just moving the elongated member 100 in the channel 21 and without user interaction with the release member 40.

Figure 6:
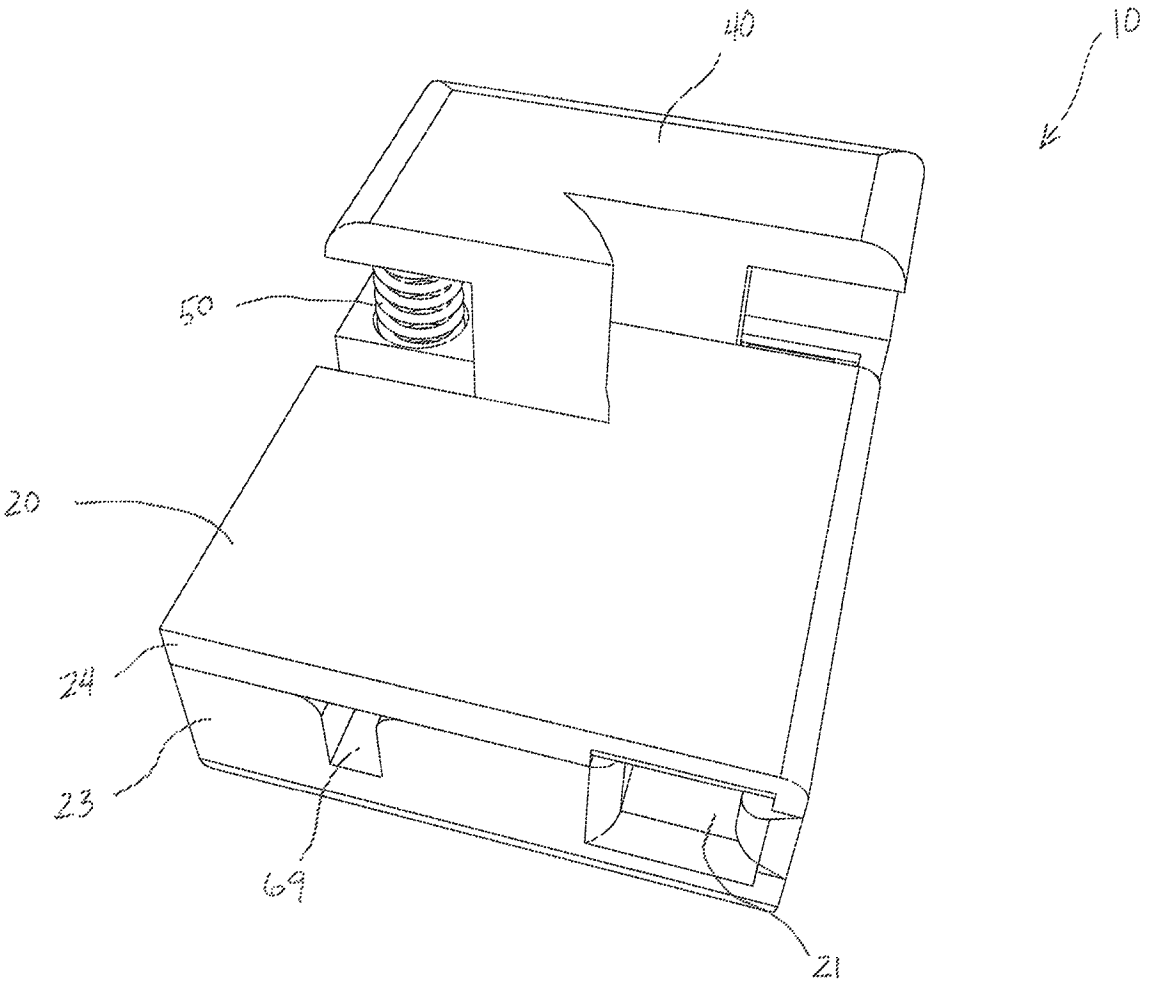
FIG. 6 is a perspective view of a catch.
Figure 7:
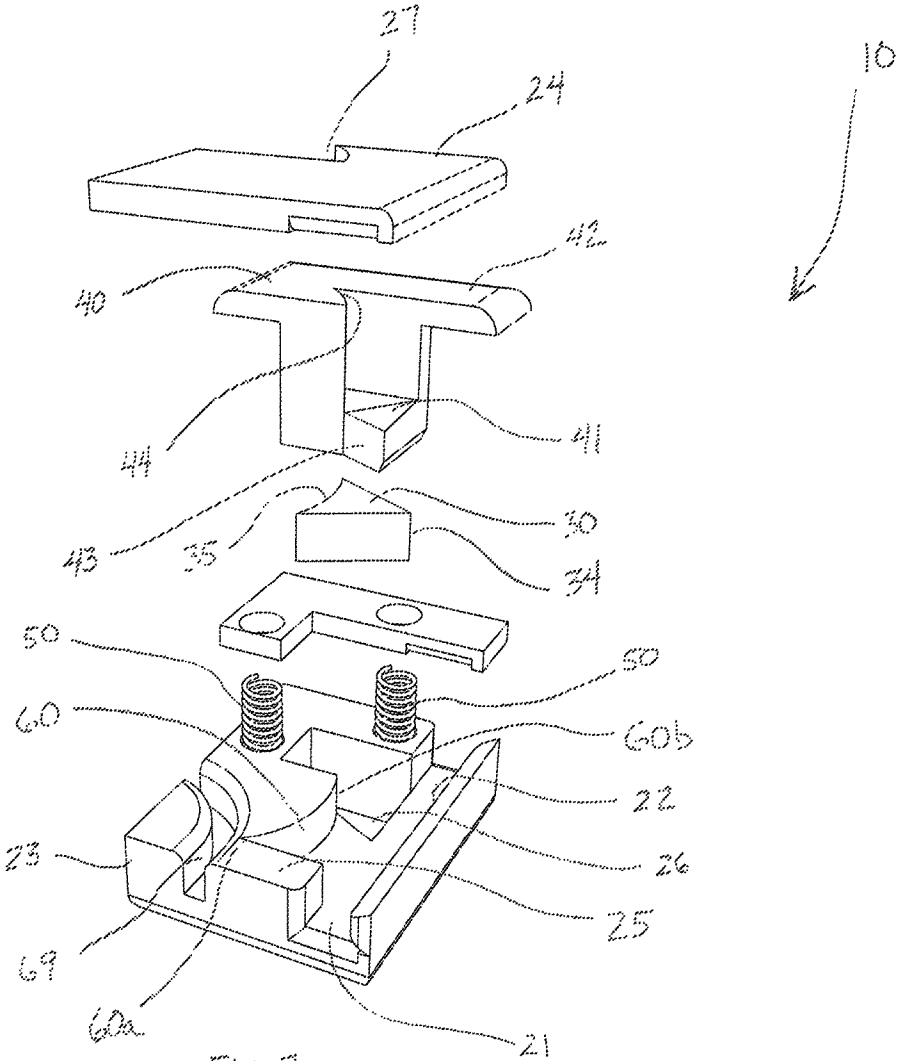
FIG. 7 is an exploded perspective view of the catch of FIG. 6.
Figure 3:
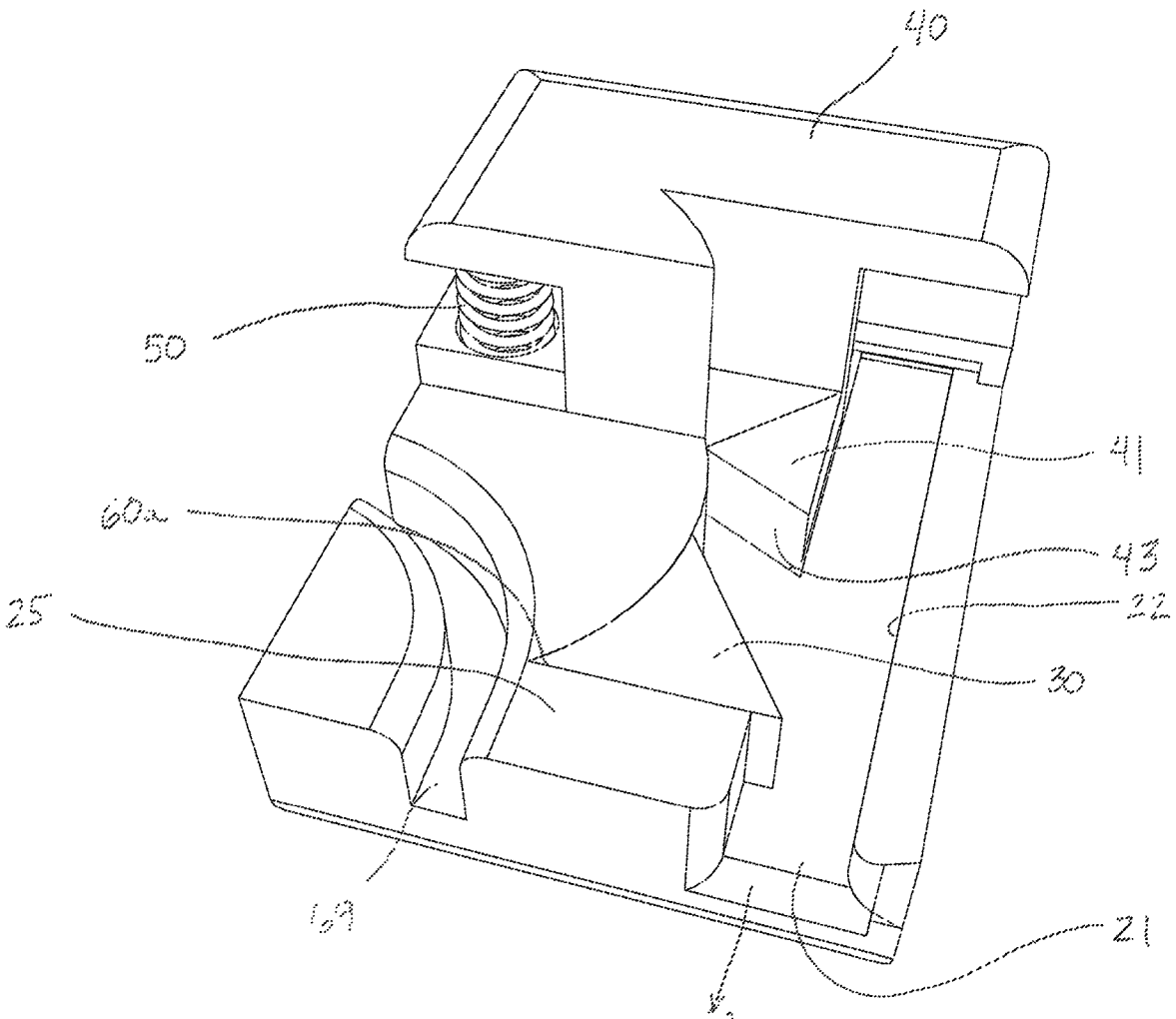

FIGS. 6-10 illustrate another catch 10 with a body 20, locking mechanism 30, and a release member 40. The body 20 includes a channel 21 to receive the elongated member 100 (not illustrated in FIGS. 6-10 for purposes of clarity). As illustrated in FIGS. 6 and 7, the body 20 includes a bottom section 23 and a top section 24. A contact sidewall 22 extends along one side of the channel 21. A curved contact edge 60 is positioned along an opposing side of the channel 21. The curvature of the edge 60 is the same along the length that extends between a first end 60*a* and a second end 60*b*. The first end 60*a* is spaced farther away from the contact sidewall 22 than the second end 60*b*. A post 25 is positioned at the first end 60*a* of the curved contact edge 60, and a recess 26 that extends into the floor of the bottom section 23 is positioned at the second end 60*b* of the curved contact edge 60.

The locking member 30 includes a triangular shape. The locking member 30 includes a tip 34 formed at the intersection of opposing angular sides, and a curved contact edge 35 that slides along the contact edge 60 of the body 20. The contact edge 35 includes the same curvature as the contact edge 60 to facilitate the sliding movement. The locking member 30 further includes a flat bottom that contacts against and slides along the flat floor of the bottom section 23 of the body 20.

The release member 40 includes a first section 41 and a second section 42. The first section 41 includes a contact edge 43 that is configured to contact against the locking member 30 as will be explained below. The second section 42 is positioned vertically above the first section 41 and is configured to extend through a cut-out 27 in the top section 24 of the body 20. One or more biasing members 50 contact against the release member 40 and bias it upward.

Figure 9:
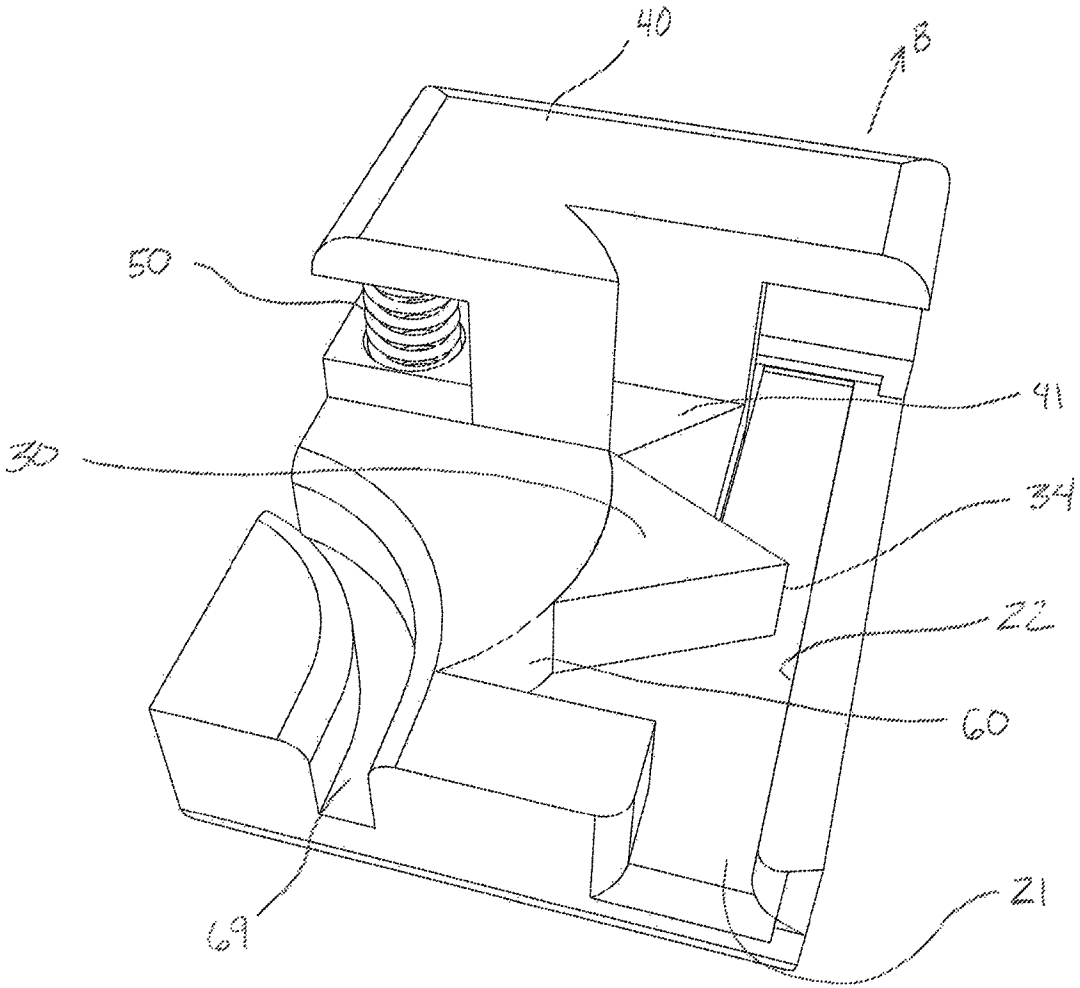
FIG. 9 is a perspective view of the interior of the catch of FIG. 6 with the catch in a second orientation.
Figure 10:
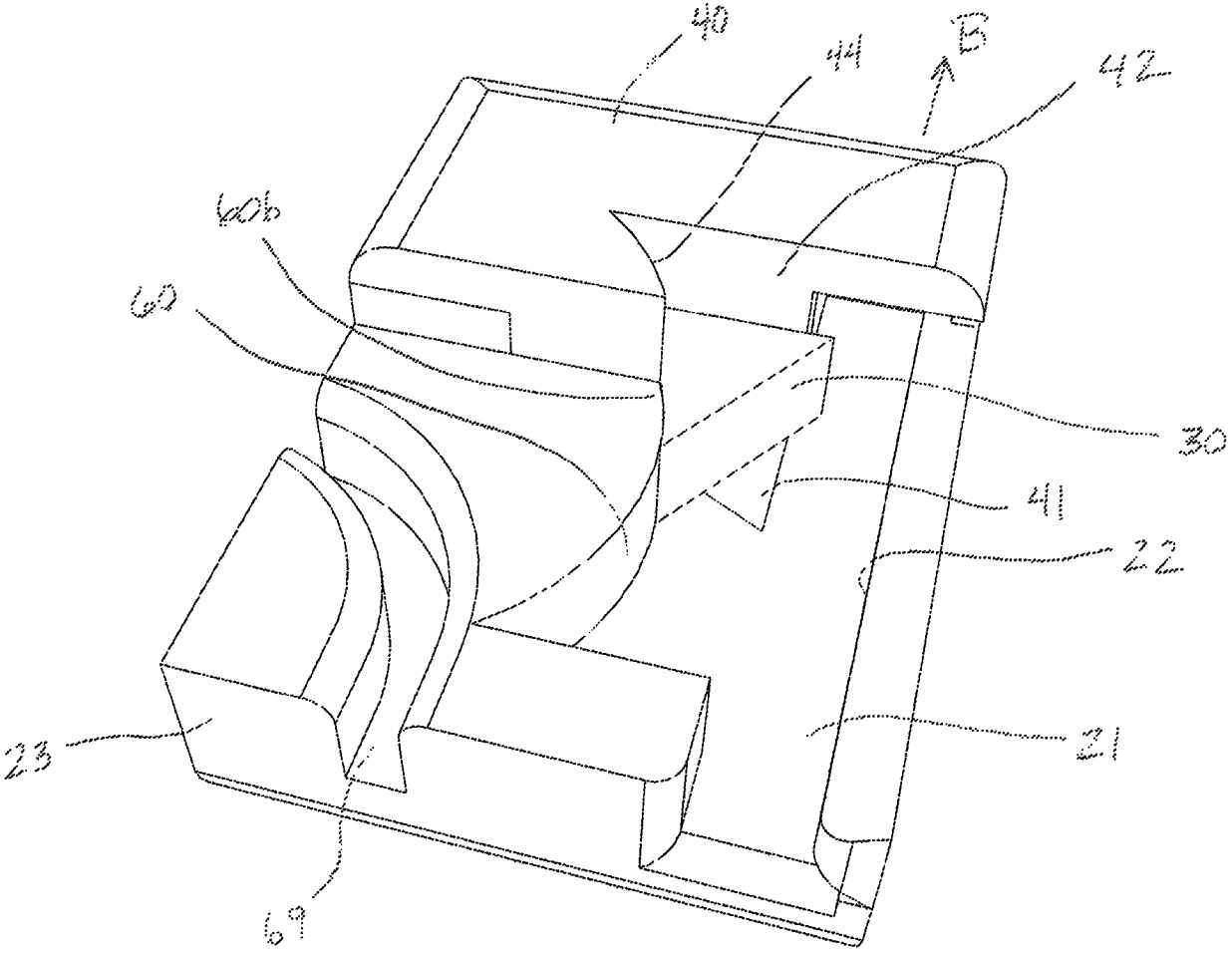
FIG. 10 is a perspective view of the interior of the catch of FIG. 6 with the catch in a third orientation.

FIG. 8 illustrates the catch 10 in the first orientation with the locking member 30 at the first end 60*a* of the contact edge 60 (The top section 24 is not illustrated in FIGS. 8-10 for clarity in viewing the interior of the catch 10. Further, the elongated member 100 is not illustrated in these Figures.). This positioning is caused by the elongated member moving through the channel 21 in the direction of arrow A. The extent of movement of the locking member 30 along the contact edge 60 is limited by the side of the locking member 30 abutting against the post 25 at the first end 60*a*. In the first orientation, the elongated member 100 may be moved along the channel in the direction of arrow A.

Movement of the elongated member 100 in the opposing direction B causes the locking member 30 to move to the second orientation as illustrated in FIG. 9. The contact between the elongated member 100 and locking member 30 slides the locking member 30 along the contact edge 60. The extent of movement is limited by the locking member 30 contacting against the contact edge 43 of the first section 41 of the release member 40. This orientation places the tip 34 of the locking member 30 farther into the channel 21. The tip 34 is in closer proximity to the contact sidewall 22 in this second orientation than in the first orientation thus preventing further movement of the elongated member 100 in direction B. The tip 34 moves against and compresses the elongated member 100 thus preventing further movement in the second direction B. In the second orientation, the elongated member 100 can be moved in the first direction as the contact between the locking member 30 and the elongated member 100 causes the locking member 30 to move back towards the first orientation.

Additional movement of the elongated member 100 in direction B requires the user to depress the release member 40 as illustrated in FIG. 10. This movement causes the top of the first section 41 of the release member 40 to move below or become aligned with the floor of the bottom section 23. This positioning allows for the locking member 30 to slide over the first section 41 of the release member 40 and to move farther along the channel 21. The locking member 30 moves beyond the end 60*b* of the contact edge 60 and along a curved surface 44 of the release member 40. The curvature of the curved surface 44 causes the locking member 30 to move away from the contact sidewall 22 thus allowing the elongated member 100 to slide along the channel 21 in the direction of arrow B and through the catch 10. That is, the elongated member 100 is able to move past the locking member 30 in the direction B in the third orientation. In the third orientation, the elongated member 100 can be moved in the first direction as the contact between the locking member 30 and the elongated member 100 causes the locking member 30 to move back towards the first orientation.

In each of the orientations, the locking member 30 remains in contact with the elongated member 100. This contact causes the locking member 30 to move along the contact edge 60 and curved surface 44 between the various orientations.

In the third orientation, the locking member 30 is positioned over the first section 41 of the release member 40. This maintains the release member 40 in the depressed position as explained above. Movement of the locking member 30 away from the release member 40 due to movement of the elongated member 100 in the first direction A allows for the biasing member(s) 50 to bias the release member 40 to the upward orientation. The one or more biasing members 50 may be positioned below the release member 40.

One or more of the embodiments may include an additional channel 69 as illustrated in FIGS. 6-10. The channel 69 is provided to receive the free end of the elongated member 100.

Figure 11:
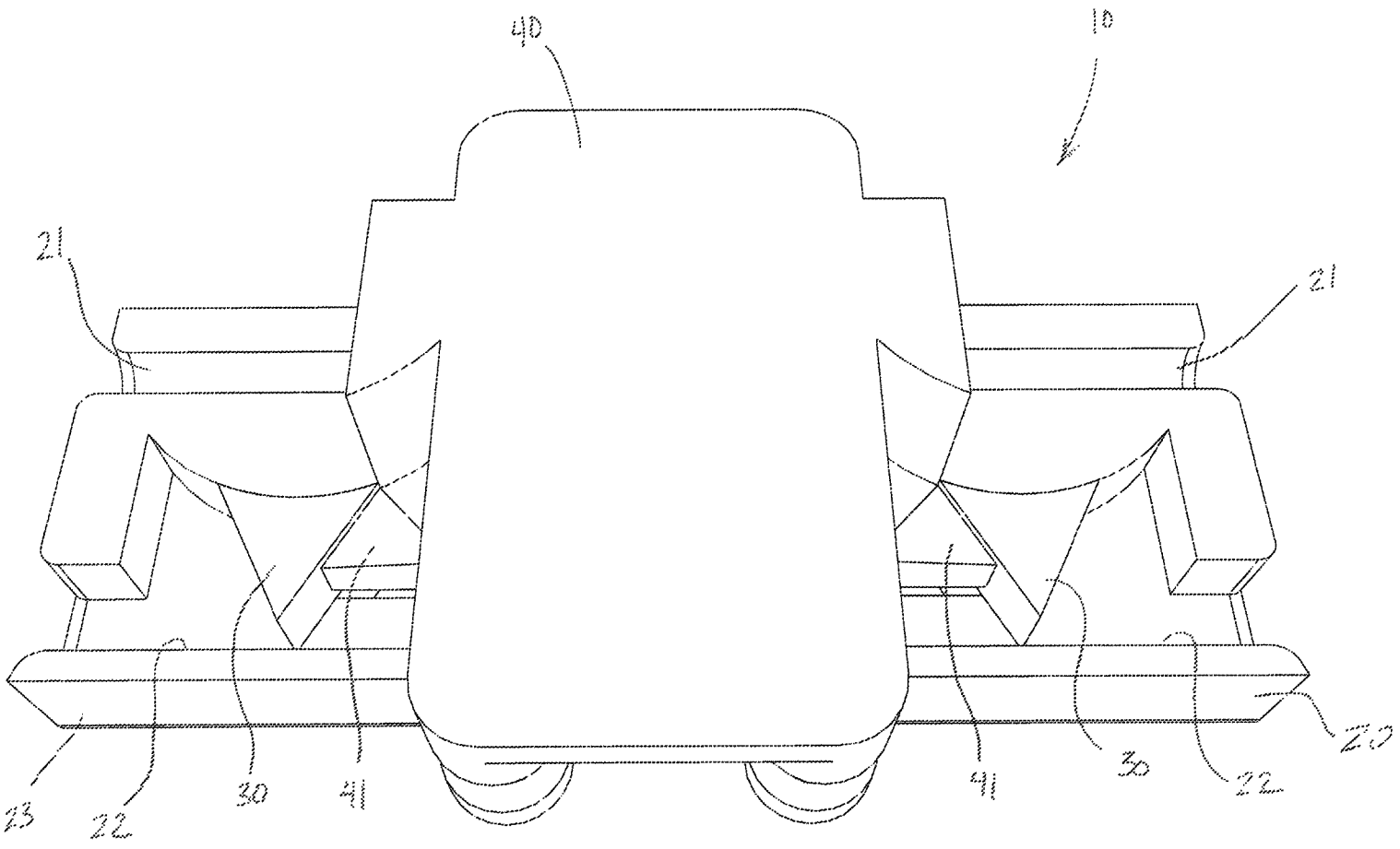
FIG. 11 is a perspective view of an interior of a catch.
Figure 12:
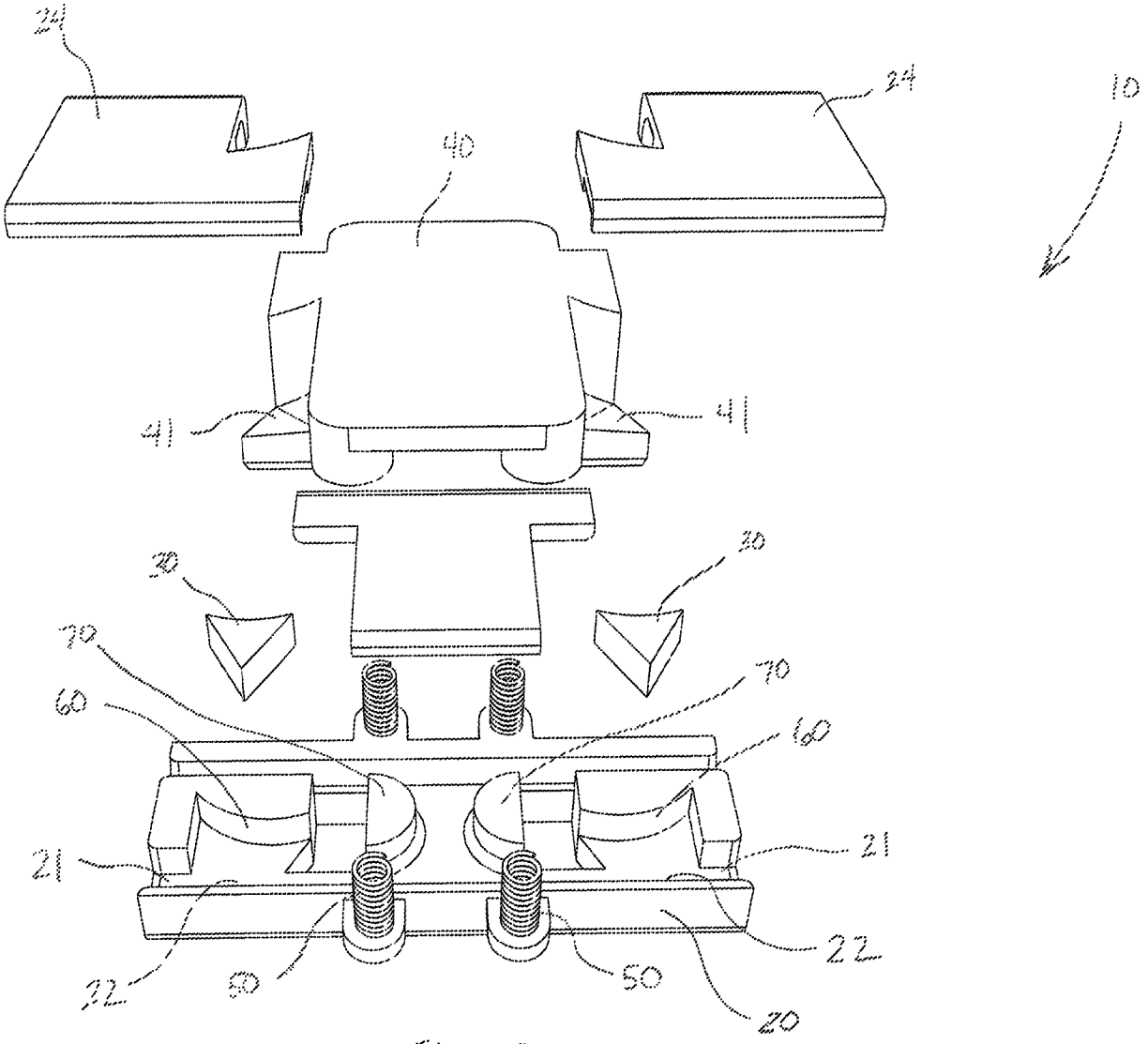
FIG. 12 is an exploded perspective view of the catch of FIG. 11.
Figure 13:
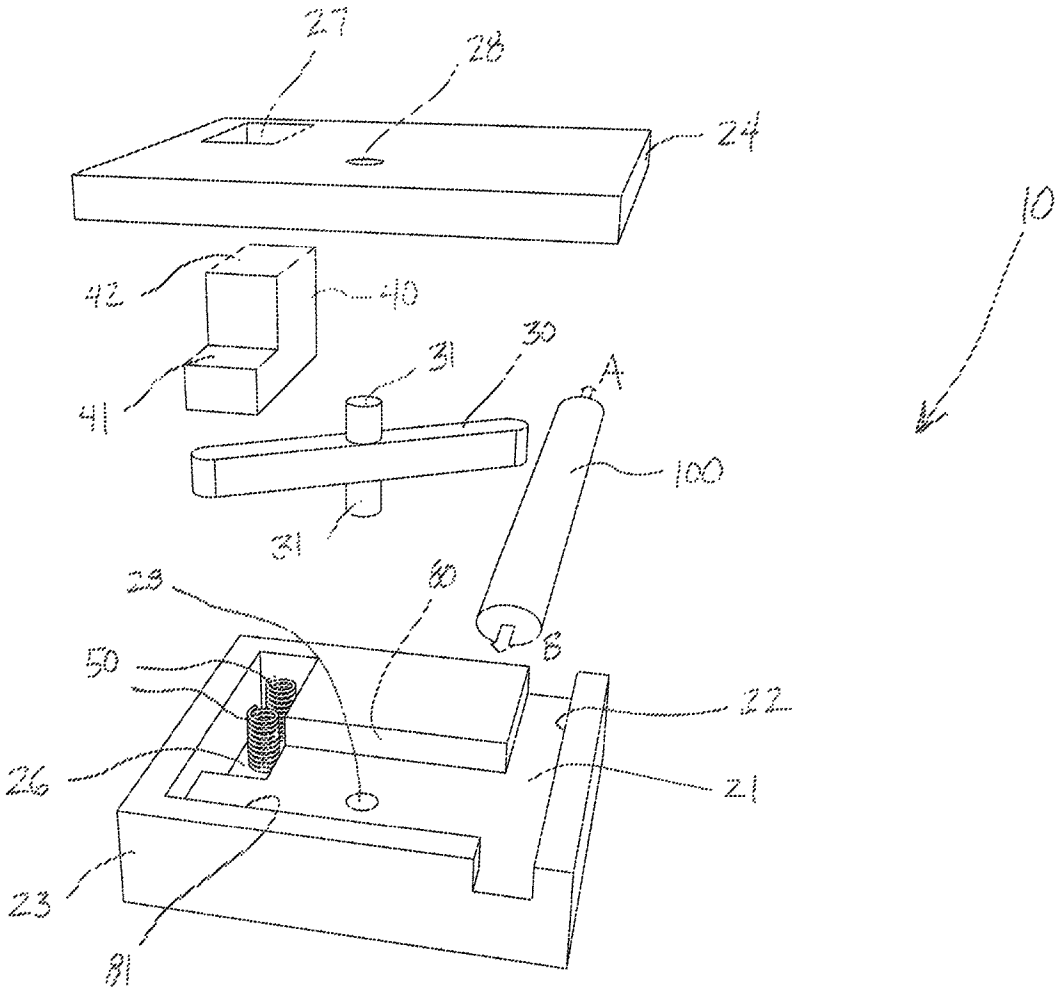
FIG. 13 is an exploded perspective view of a catch and an elongated member.

FIGS. 11 and 12 include a similar arrangement, but with the catch 10 configured to receive two elongated members 100 (FIG. 11 includes the top section 24 of the body removed to allow viewing of the interior.) The catch 10 includes first and second channels 21 that are each configured to receive an elongated member 100 (not illustrated). Further, the channels 21 are each curved and are configured in the shape of a "U". The first channel 21 includes a pair of openings on the first end of the body 20, and the second channel 21 includes a pair of openings on a second end of the body 20. Each channel 21 is formed in part by a back member 70 that forms an inner sidewall of the channels 21. As illustrated in FIG. 12, each channel 21 extends inward from an end of the body 20, extends around one of the back members 70, and extends outward through the same end of the body 20.

Each of the channels 21 further includes a contact sidewall 22 on an opposing side from a curved contact edge 60. Locking members 30 move along the contact edges 60 as previously discussed. A single release member 40 includes a pair of opposing first sections 41. Each one of the first sections 41 is positioned at one of the channels 21 and provides for the locking members 30 to move to the third orientation to provide for movement of the elongated member 100 along the channel 21. FIG. 11 illustrates the locking members 30 in the second orientation in contact against the first sections 41.

The embodiment of FIGS. 11 and 12 includes a single release member 40. Movement of the release member 40 into the bottom section 23 of the body 20 allows for the additional movement of the elongated members 100 in each respective channel 21. Separate release members 40 (not illustrated) may be positioned along each channel 21 to provide for independent control of the channels 21.

FIGS. 13-16 include a catch mechanism 10 with a locking member 30 having an elongated straight shape. Posts 31 extend outward from the upper and lower sides of the locking member 30 and extend into openings 28 in the bottom and top sections 23, 24 of the body 20. The release member 40 includes a stepped configuration with first and second steps 41, 42. One or more biasing members 50 bias the release member 40 upward from the recess 26 in the floor of the bottom section 23.

Figure 14:
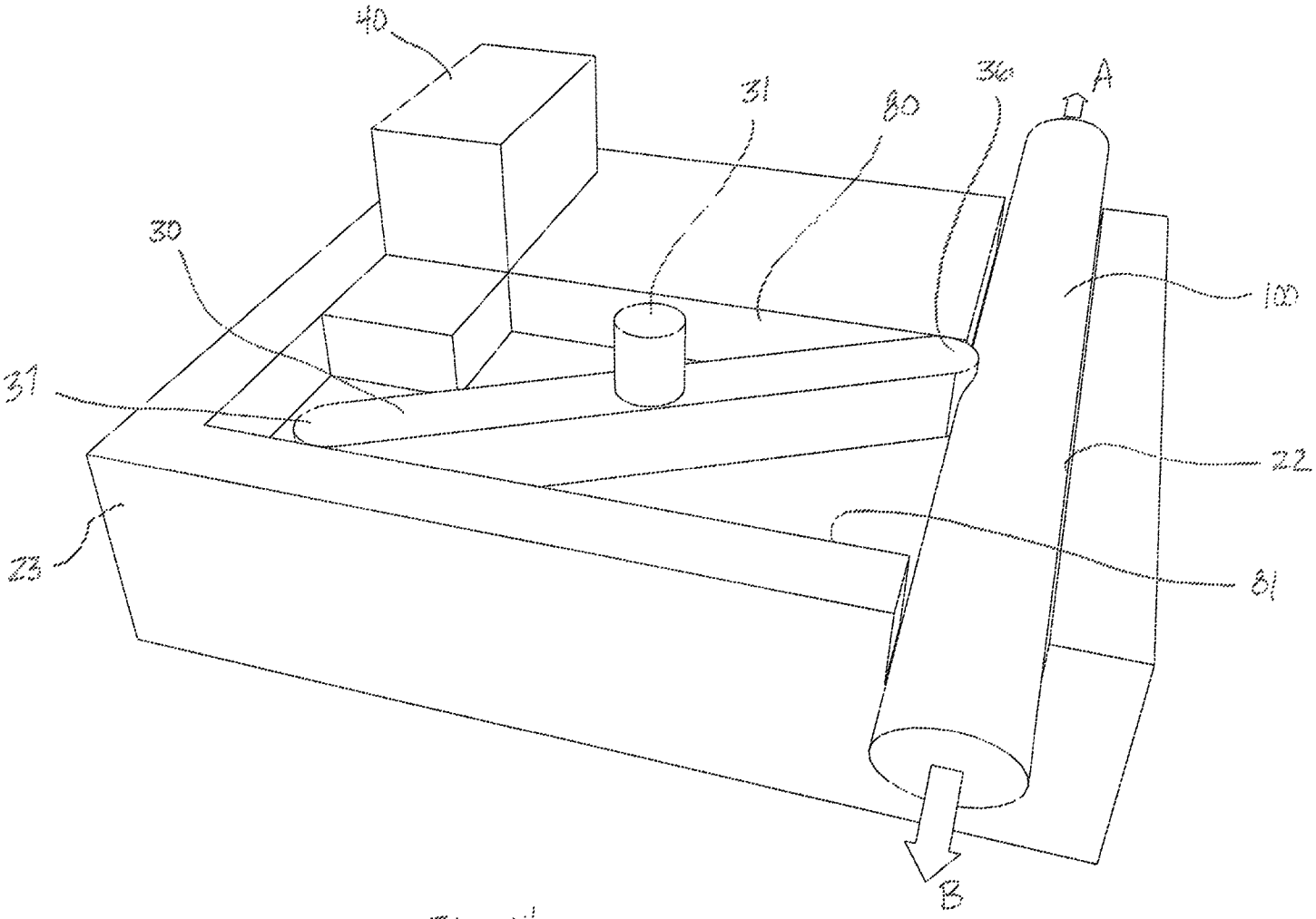
FIG. 14 is a perspective view of an interior of the catch of FIG. 13 with the catch in a first orientation.

FIG. 14 illustrates the locking member 30 in a first orientation that occurs when the elongated member 100 is moved in the channel 21 in the first direction indicated by arrow A. The contact between the locking member 30 and the elongated member 100 pivots the locking member 30 to this position. The extent of pivoting movement of the locking member 30 may be limited by contact between the first end 36 of the locking member 30 and a first sidewall 80 and/or a second end 37 of the locking member 30 and a second sidewall 81. In this orientation, the locking member 30 is positioned a distance away from the contact sidewall 22 to maintain contact with the elongated member 100 and still allow for movement in the first direction A.

Figure 15:
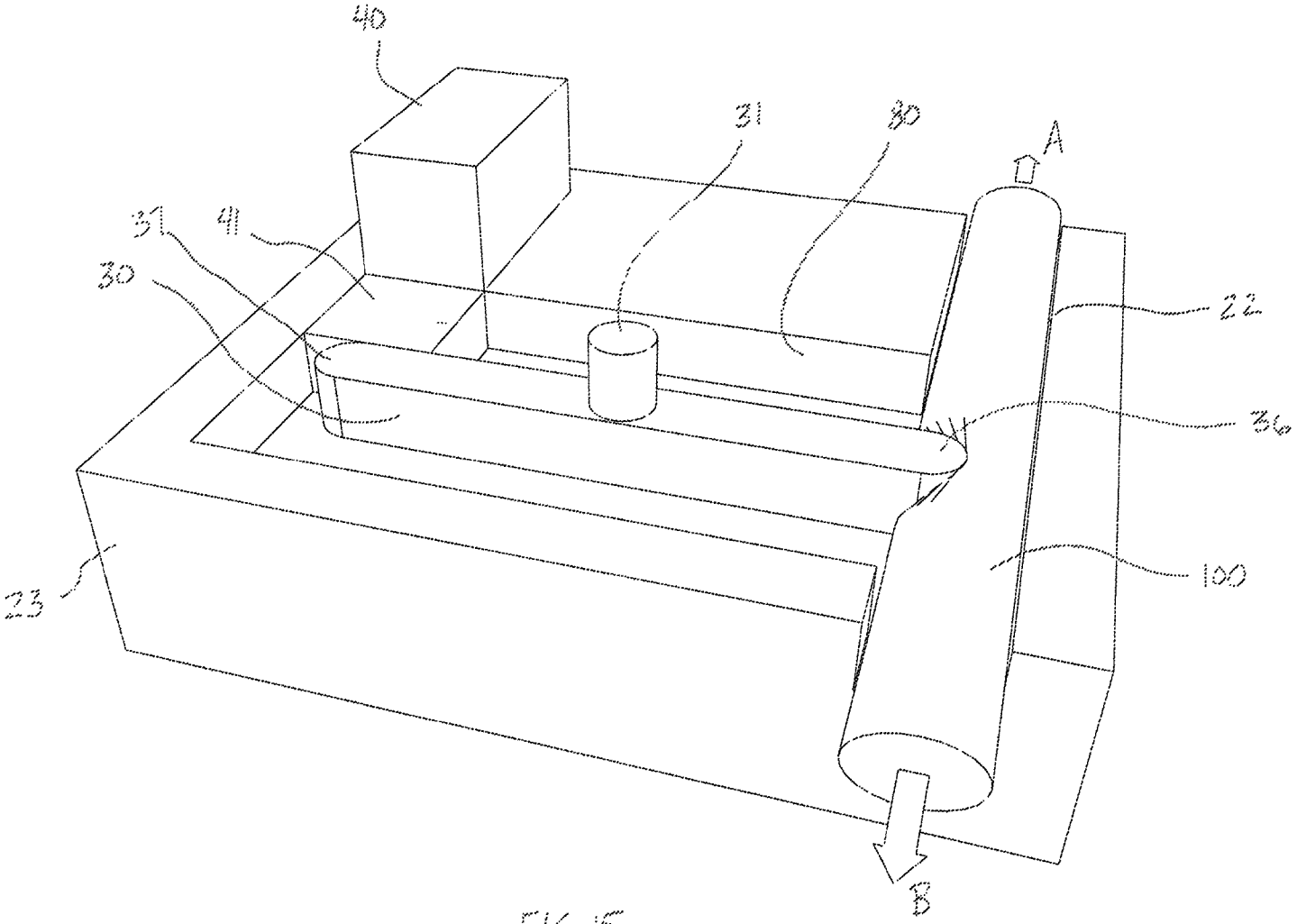
FIG. 15 is a perspective view of an interior of the catch of FIG. 13 with the catch in a second orientation.

FIG. 15 illustrates the locking member 30 in a second orientation. This orientation may occur by movement of the elongated member 100 in the direction of arrow B. As compared to FIG. 14, the locking member 30 has pivoted about the posts 31 with the first end 36 extending a greater distance into the channel 21 and closer to the contact sidewall 22. This contact compresses the elongated member 100 and prevents farther movement of the elongated member 100 in the direction of arrow B. The extent of the pivoting movement of the locking member 30 is controlled by the contact with the release member 40. Specifically, the locking member 30 abuts against the sidewall of the first section 41 of the release member 40 that extends above the floor of the bottom section 23 of the body 20. In the second orientation, the elongated member 100 can be moved in the first direction of arrow A as the contact between the locking member 30 and the elongated member 100 causes the locking member 30 to move back towards the first orientation.

Figure 16:
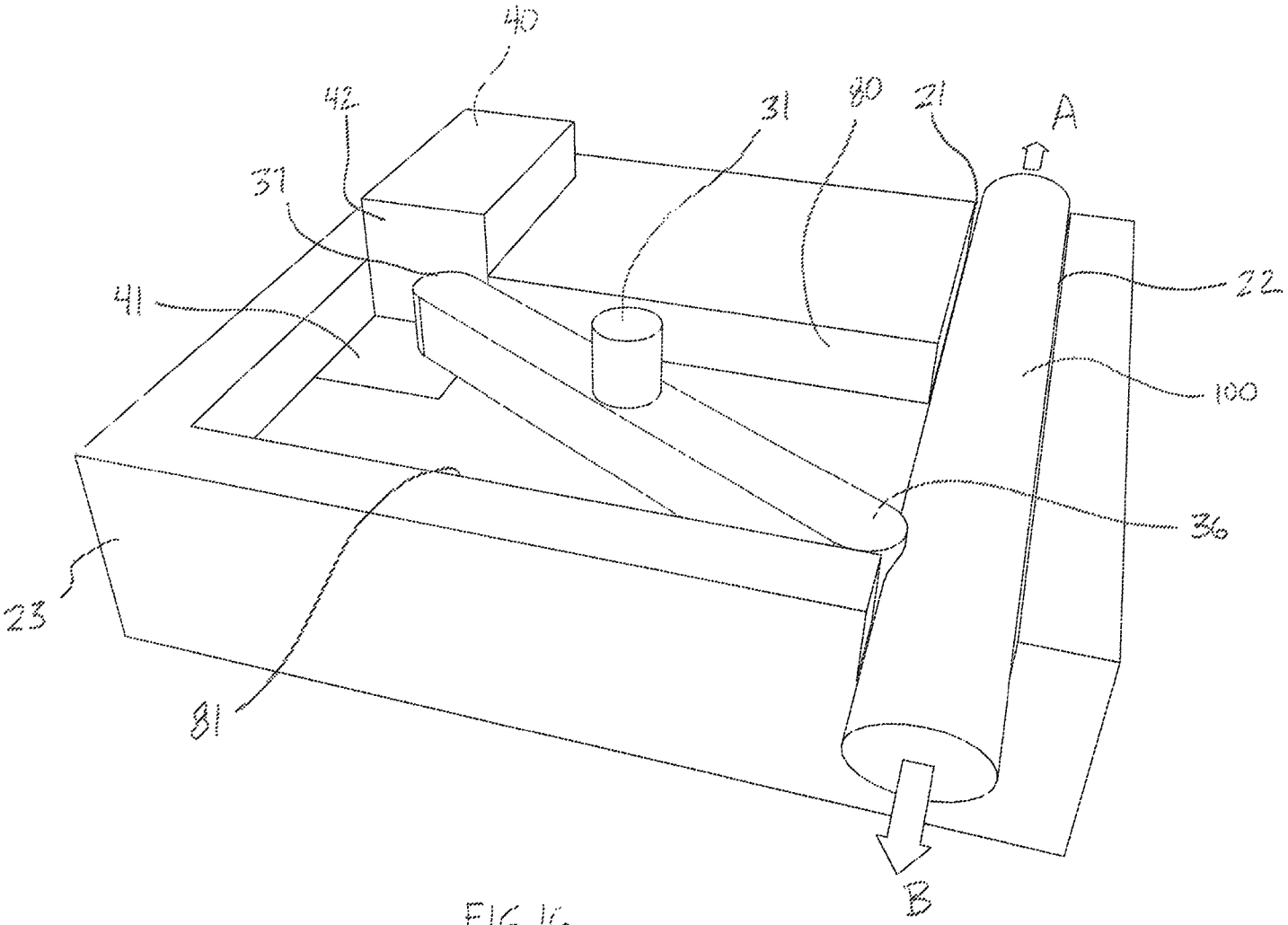
FIG. 16 is a perspective view of an interior of the catch of FIG. 13 with the catch in a third orientation.

FIG. 16 illustrates the locking member 30 in a third orientation in which the elongated member 100 is able to move past the locking member 30 in the direction of arrow B. The release member 40 has been depressed with the top of the first section 41 positioned below or flush with the floor of the bottom section 23. This provides for the locking member 30 to move over the first section 41. This moves the opposing end 36 of the locking member 30 further away from the contact sidewall 22 and allows movement of the elongated member 100 in the direction of arrow B. The extent of movement of the locking member 30 may be limited by contact with one or more of the sidewalls of the second section 42 of the release member 40, the sidewall 80, and the sidewall 81. In the third orientation, the elongated member 100 can be moved in the first direction of arrow A as the contact between the locking member 30 and the elongated member 100 causes the locking member 30 to move back towards the first orientation.

The locking member 30 remains in contact with the member 100 in the three orientations to provide a force for moving the locking member 30 between the three orientations.

FIGS. 17-21 illustrate an embodiment that includes a pair of release members 40*a*, 40*b*. This embodiment provides for the locking member 30 to be selectively positioned to control the movement of the elongated member 100 in the first and second directions indicated respectively by arrows A and B. Each of the release members 40*a*, 40*b* can be individually moved from a blocking position to a non-blocking position to allow movement of the elongated member 100 in one direction. The release members 40*a*, 40*b* can be used together to control the movement of the elongated member 100 in both directions. In the various orientations, the locking member 30 remains in contact with the elongated member 100 to provide the force for moving the locking member 30.

Figure 17:
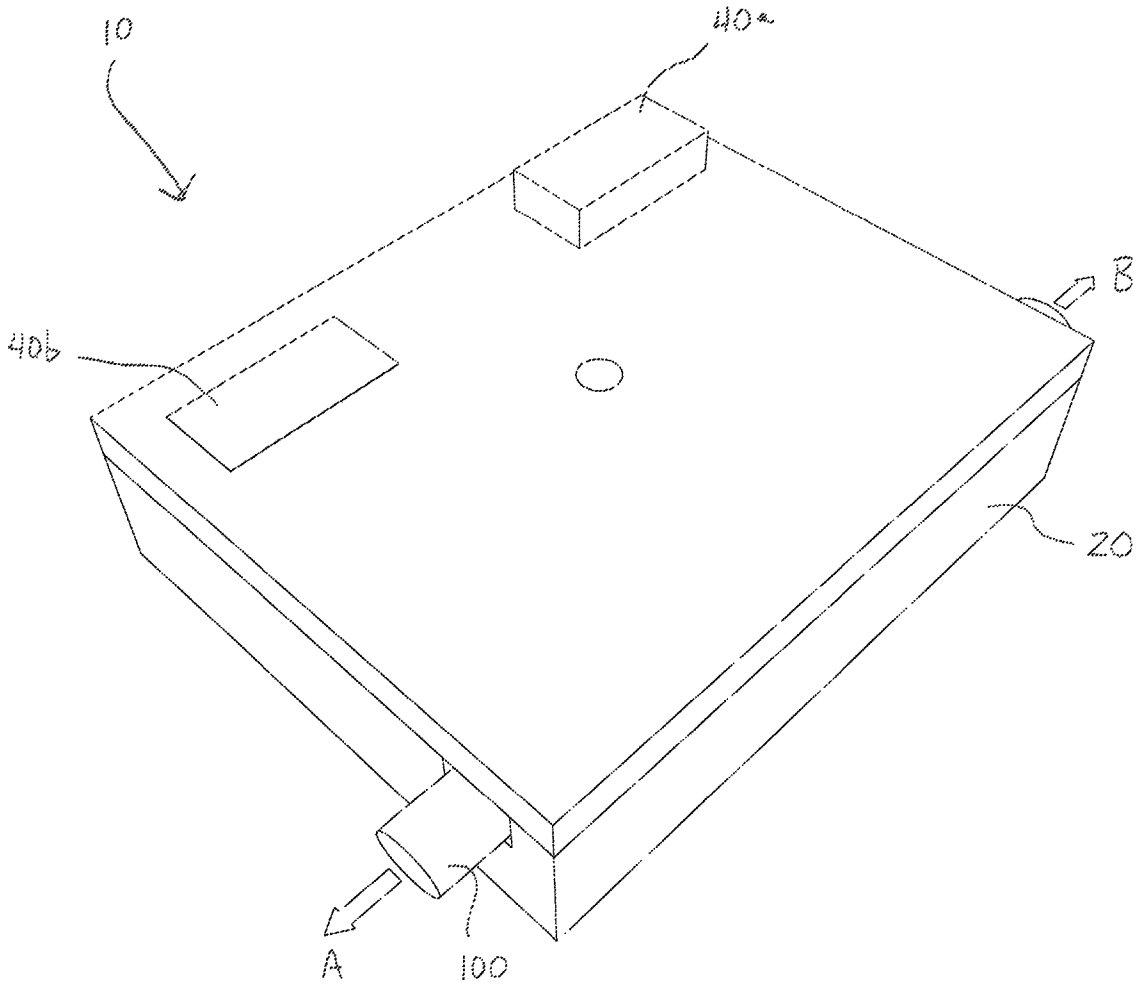
FIG. 17 is a perspective view of a catch.
Figure 18:
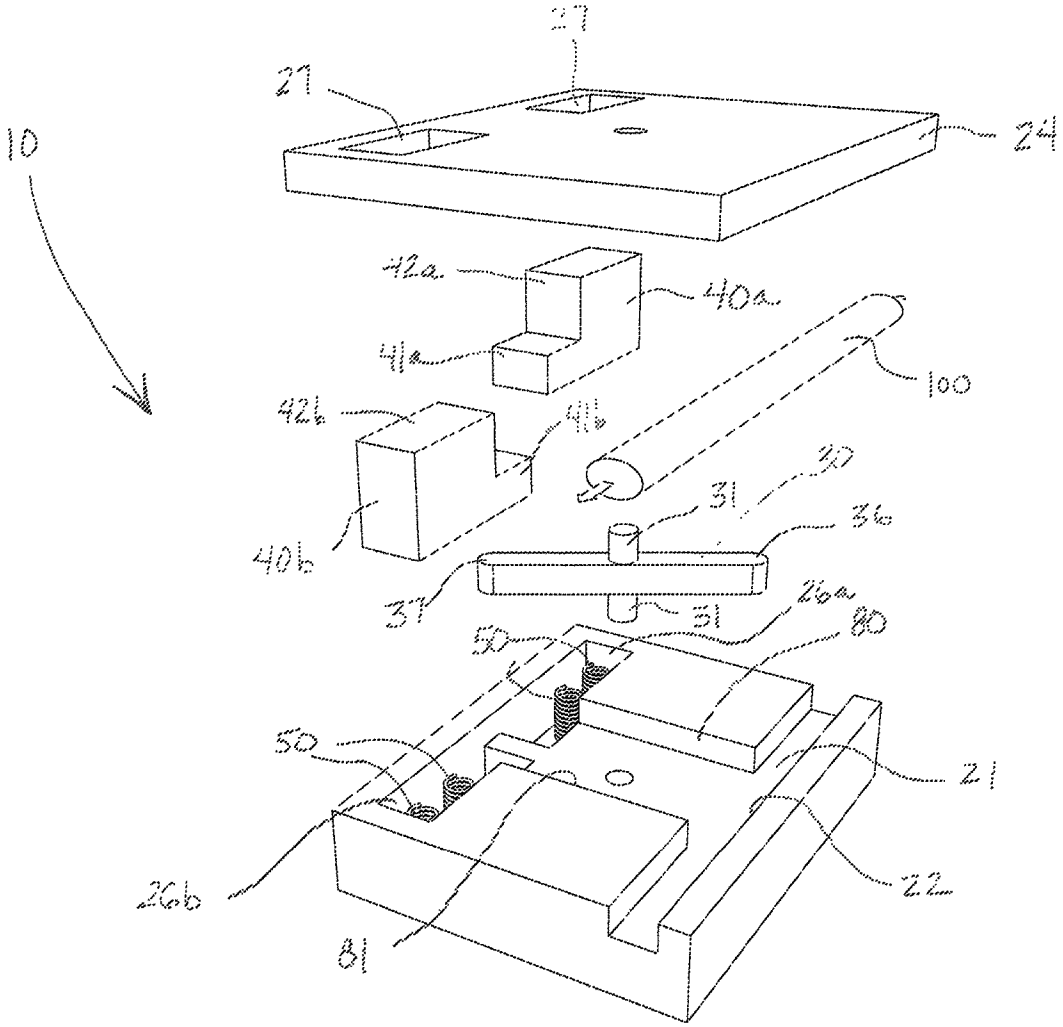
FIG. 18 is an exploded perspective view of the catch of FIG. 17.

As illustrated in FIGS. 17 and 18, each release member 40*a*, 40*b* includes a first section 41*a*, 41*b* and a second section 42*a*, 42*b* respectively. The release members 40*a*, 40*b* may include the same or different shapes and sizes. The first release member 40*a* is positioned at a first recess 26*a* in the floor of the bottom section 23 and the second release member 40*b* is positioned at a second recess 26*b* also in the floor. A single elongated locking member 30 is positioned in the body 20 with a first end 36 at the elongated member 100 and a second end 37 between the release members 40*a*, 40*b*. The locking member 30 is pivotally mounted to the body 20 through posts 31 that seat within openings in the bottom and top sections 23, 24 of the body 20. The locking member 30 is further positioned between sidewalls 80, 81 formed in the bottom section 23.

Figure 19:
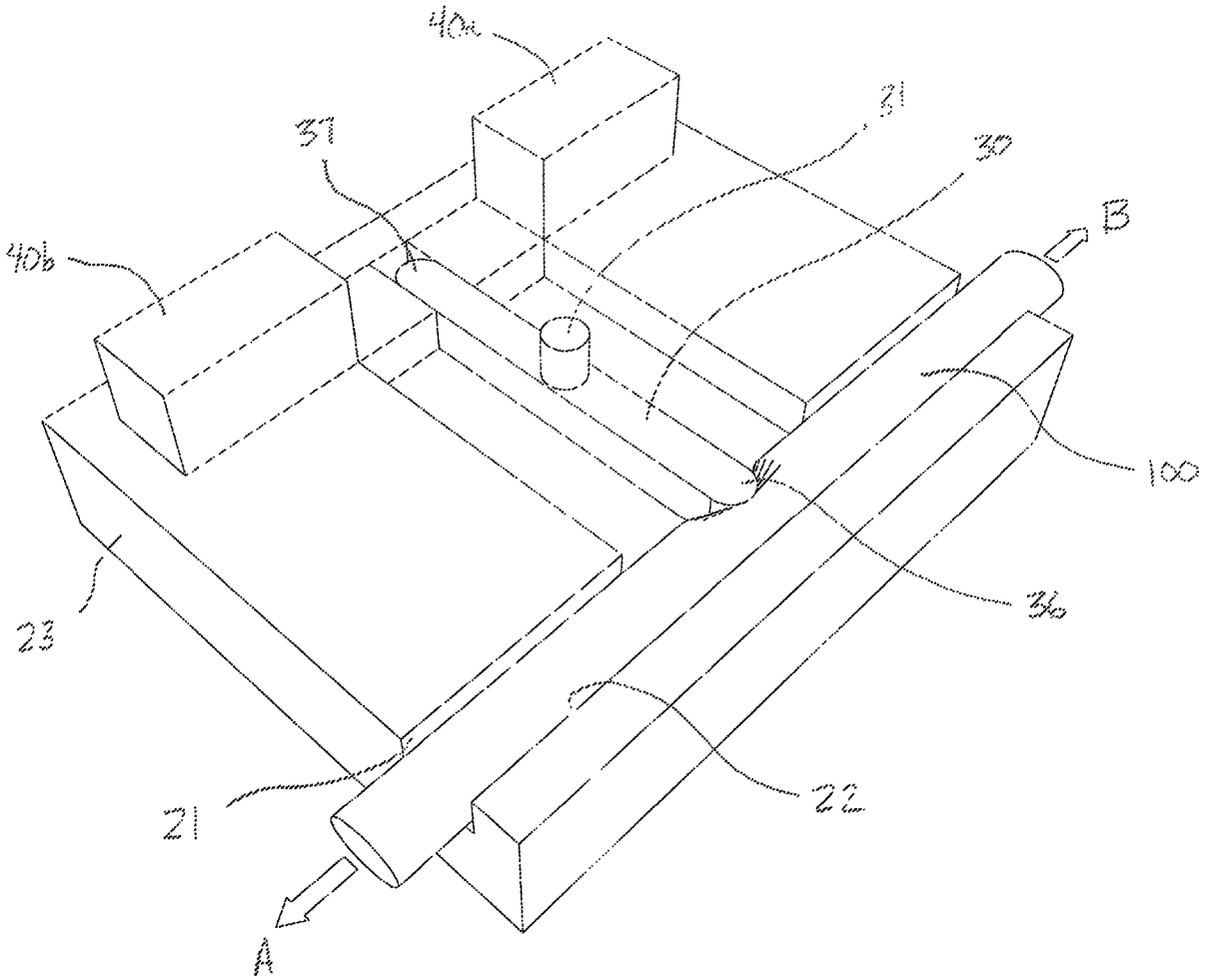
FIG. 19 is a perspective view of an interior of the catch of FIG. 17 with the catch in a first orientation.

FIG. 19 illustrates the catch 10 in a first orientation with the elongated member 100 locked along the channel 21. This orientation includes each of the release members 40*a*, 40*b* in a raised orientation with the first sections 41*a*, 41*b* elevated above the floor of the bottom section 23. The second end 37 of the locking member 30 positioned in the gap between the release members 40*a*, 40*b*. This orientation places the first end 36 of the locking member 30 in proximity to the contact sidewall 22 and against the elongated member 100. The length of the locking member 30 causes the elongated member 100 to be compressed by the member 30 against the contact sidewall 22 thus locking the position. This first orientation prevents movement of the elongated member 100 along the channel 21 in either of first or second directions indicated by arrows A and B respectively.

Figure 20:
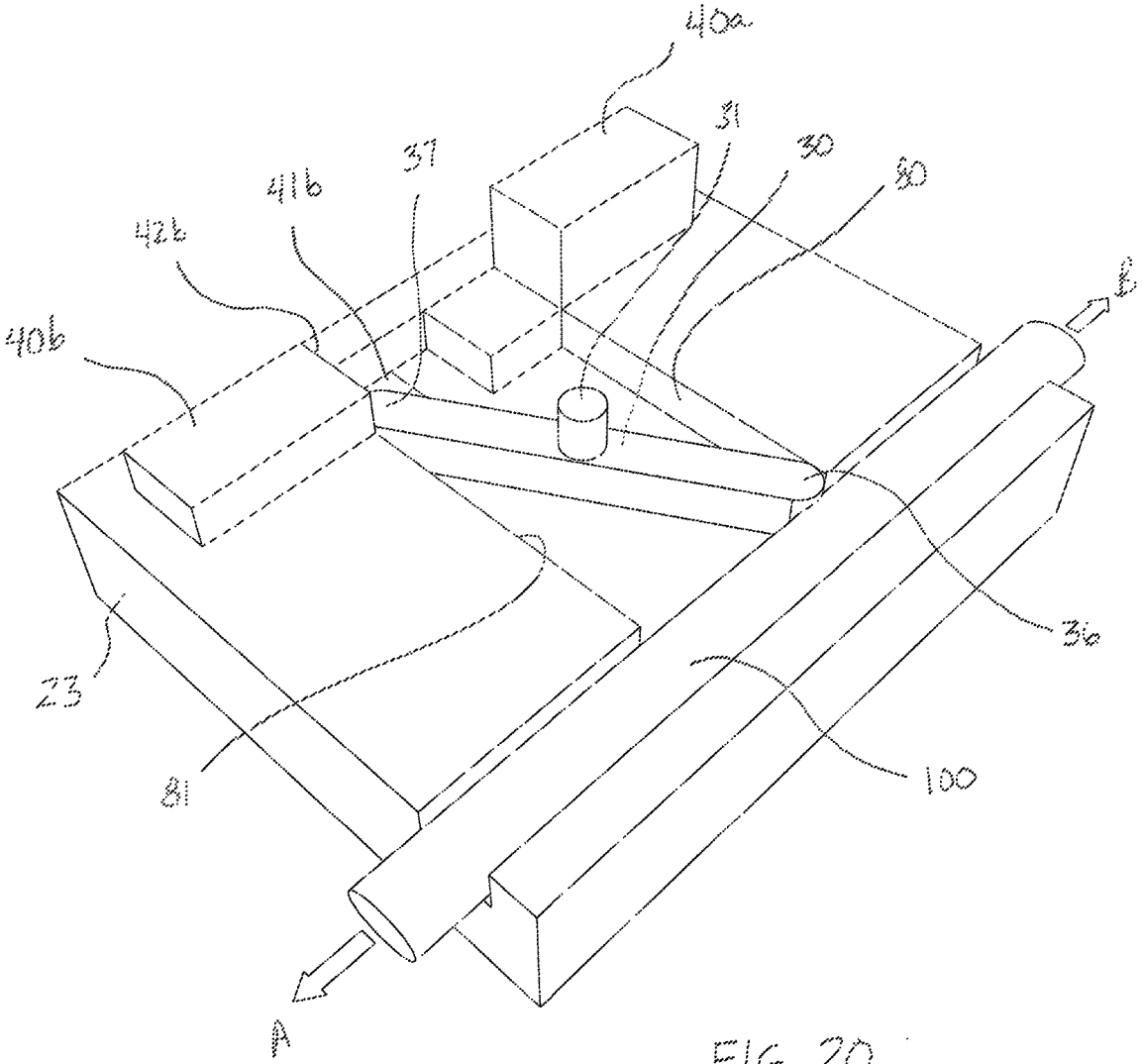
FIG. 20 is a perspective view of an interior of the catch of FIG. 17 with the catch in a second orientation.

Each release member 40*a*, 40*b* can provide for movement of the elongated member in one direction. FIG. 20 includes release member 40*b* in a non-blocking position in which the elongated member 100 is able to move past the locking member 30 in the second direction indicated by arrow B. The second release member 40*b* has been depressed such that the first section 41*b* is recessed below or is flush with the floor of the bottom section 23. The first end 36 of the locking member 30 is farther from the contact sidewall 22 than the first orientation and in contact with the elongated member 100. Movement of the elongated member 100 in the direction indicated by arrow B causes the locking member 30 to pivot in that direction. The second end 37 is now able to move over the first section 41*b* of the release member 40*b*. The extent of pivoting movement of the locking member 30 about the posts 31 is limited by contact of the first end 36 against the sidewall 80 and/or contact of the second end 37 against the second section 42*b*. In this orientation, the first end 36 has moved a greater distance away from the contact sidewall 22 thus maintaining contact with the member 100 yet still allowing movement in the second direction.

In this second orientation, the elongated member 100 can be moved in the first direction of arrow A as the contact between the locking member 30 and the elongated member 100 causes the locking member 30 to move back towards the first orientation. The extent of movement is limited when the locking member 30 contacts against the release member 40*a*. Further, the release member 40*b* returns to the blocking orientation once the locking member 30 moves away from the first section 41*b*.

Figure 21:
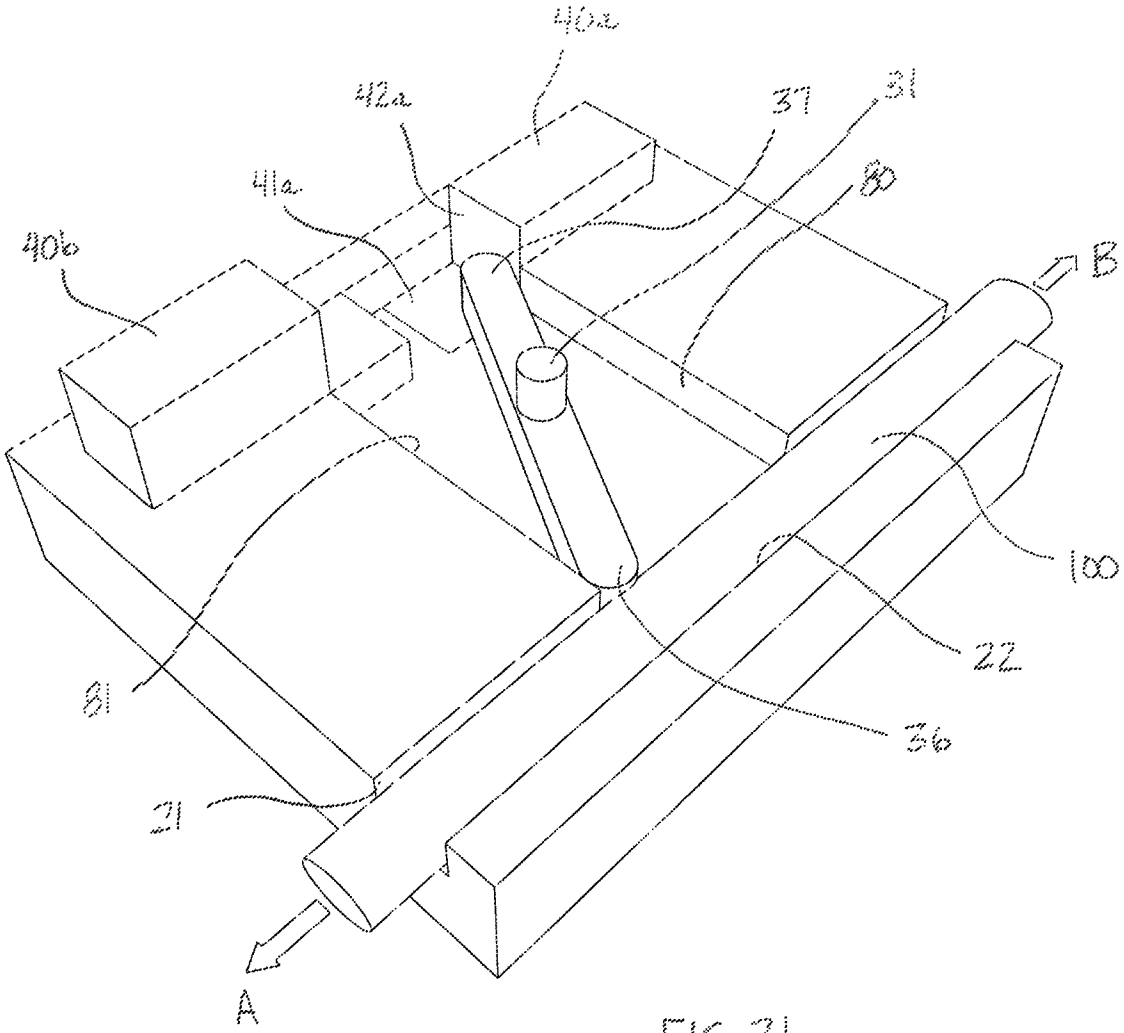
FIG. 21 is a perspective view of an interior of the catch of FIG. 17 with the catch in a third orientation.

Likewise, release member 40*a* can be moved to a non-blocking position to provide for movement of the elongated member 100 in the direction of arrow A. FIG. 21 illustrates the catch 10 in a third orientation in which the elongated member 100 is able to move past the locking member 30 in the first direction indicated by arrow A. This includes the first release member 40*a* being depressed with the top of the first section 41*a* positioned flush with or below the floor of the bottom section 23. Movement of the elongated member 100 in the direction indicated by arrow A causes the locking member 30 to pivot in the opposing direction. The second end 37 of the locking member 30 moves over the top of the first section 41*a* providing for the additional movement. The extent of movement is limited by the first end 36 contacting the sidewall 81 and/or the second end 37 contacting the second section 42*a*. The end 36 is again a distance from the contact sidewall 22 to maintain contact yet allow movement of the elongated member 100.

In the third orientation, the elongated member 100 can be moved in the second direction of arrow B as the contact between the locking member 30 and the elongated member 100 causes the locking member 30 to move back towards the first orientation. The extent of movement is limited when the locking member 30 contacts against the release member 40*b*. The release member 40*a* also returns to the blocking orientation once the locking member 30 moves away from the first section 41*a*.

In each of the second and third orientations, the first end 36 maintains contact with the elongated member 100. This contact may cause a slight deformation of the member 100, but still provide for movement along the channel 21.

Figure 22:
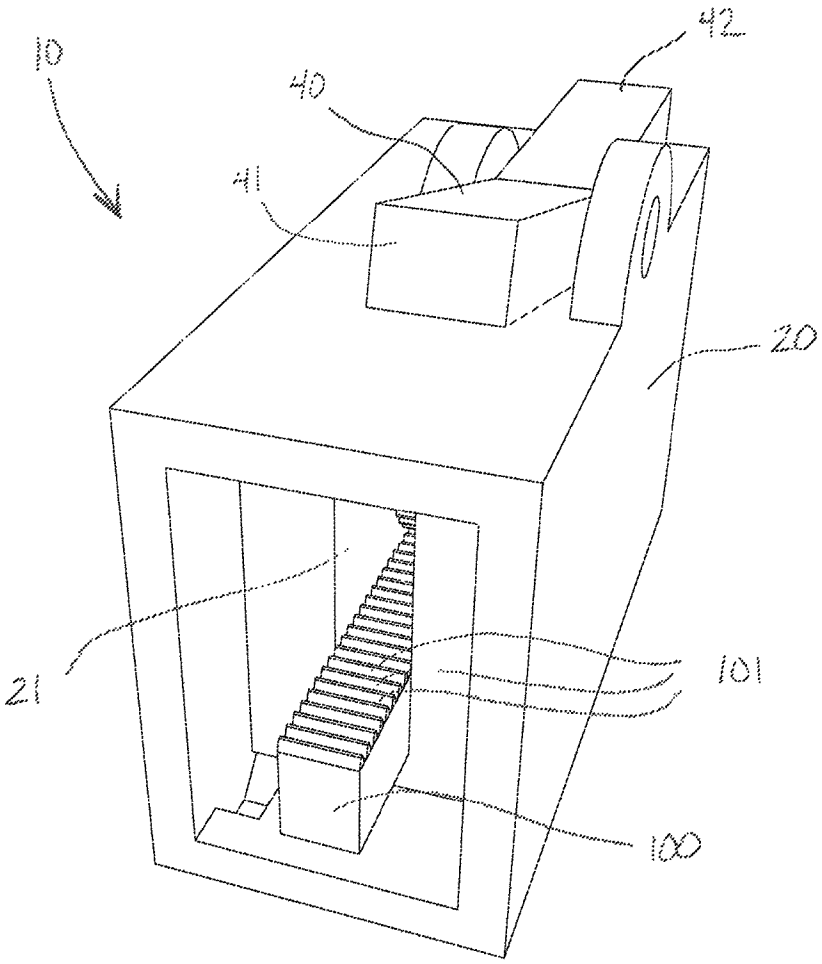
FIG. 22 is a perspective view of an elongated member extending through a catch.
Figure 23:
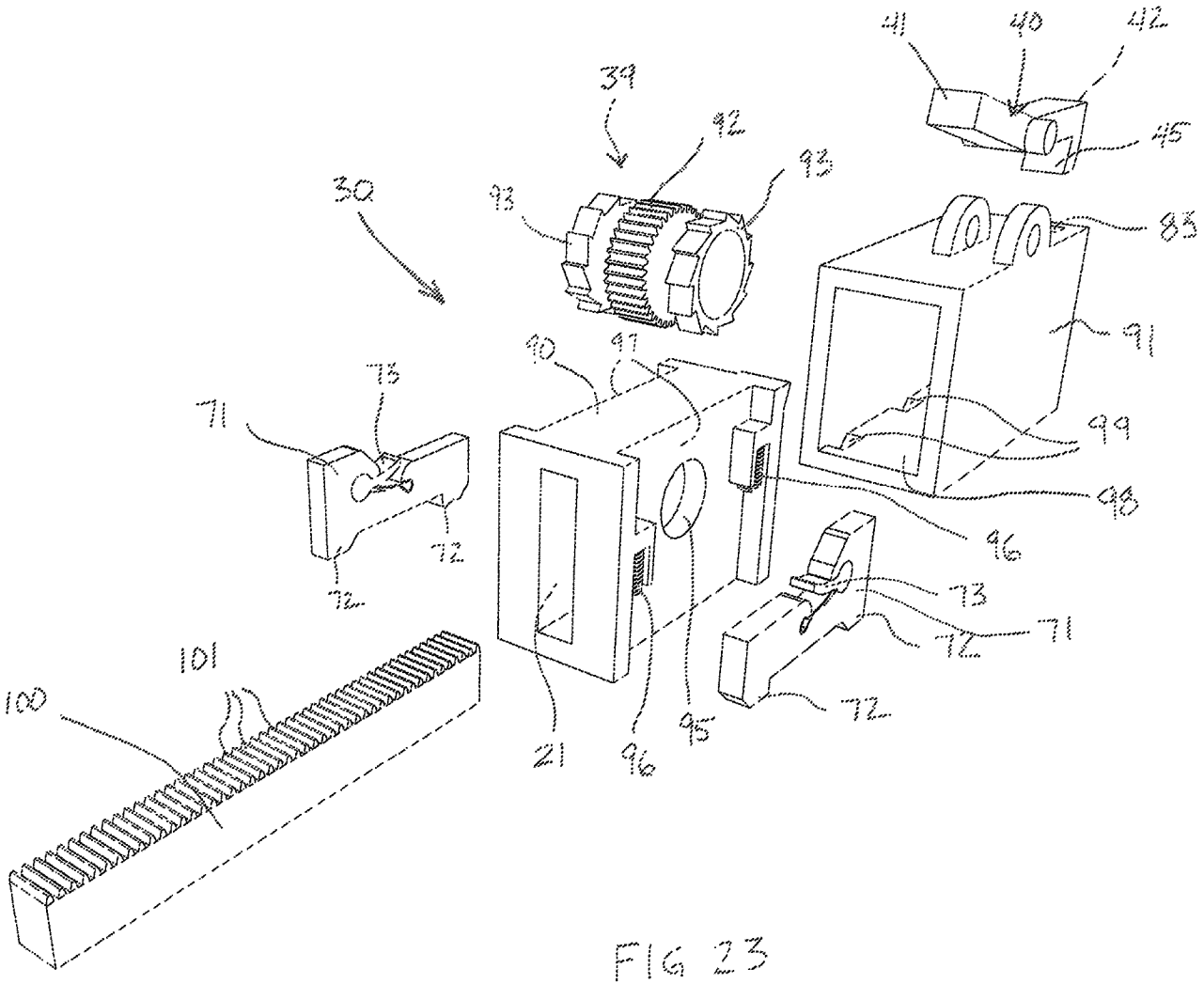
FIG. 23 is an exploded perspective view of the catch of FIG. 22.

FIGS. 22-29 disclose another embodiment that utilizes the same conceptual features that are disclosed above. FIG. 22 illustrates the catch 10 with an inserted elongated member 100, and FIG. 23 illustrates an exploded view of the catch 10 and elongated member 100. This catch 10 may be particularly applicable for use with a rigid elongated member 100, although the catch 10 may also be used with deformable elongated members 100.

The catch 10 includes an inner housing 90 that is positioned in an outer housing 91. The inner housing 90 forms the channel 21 through which the elongated member 100 extends. The inner housing 90 also includes an opening 95 to receive a contact member 39. Each opposing lateral side 97 includes a flat wall to receive a plug 71. The lateral sides 97 are also configured to receive one or more biasing members 96 that act on the plugs 71. A locking member 30 includes the contact member 39, inner housing 90, and plugs 71.

The outer housing 91 includes an interior space that receives the inner housing 90. The outer housing 91 also includes open ends through which the elongated member 100 extends. A bottom 98 includes openings 99 to receive the plugs 71. In one embodiment, a pair of openings 99 is axially spaced apart along each lateral side of the bottom 98. An opening 83 extends through the top side.

The contact member 39 includes an elongated shape that extends through the openings 95 in the inner housing 90. The contact member 39 includes a first gear 92 with teeth positioned along an intermediate section. Outer gears 93 are positioned on each side of the first gear 92. The contact member 39 extends across the inner housing 90 with the first gear 92 positioned in the channel 21 and each of the outer gears 93 positioned in the mount positions along the outer lateral sides 97. The contact member 39 is rotatable within the opening 95. In one embodiment, a small neck is formed between the first gear 92 and each of the outer gears 93. The two small necks are positioned in the openings to laterally position the contact member 39 in the inner housing 90 and also allow for the contact member 39 to rotate relative to the inner housing 90.

The release member 40 is pivotally mounted to a top of the outer housing 91. The release member 40 includes an elongated shape with a first end 41 and opposing second end 42. A tooth 45 extends downward from the second end 42. The tooth 45 is sized to extend through the opening 83 in the top side of the outer housing 91 to engage with the inner housing 90 of the locking member 30.

The plugs 71 are positioned along each outer lateral side 97 of the inner housing 90 and within the lateral sides of the outer housing 91. Each plug 71 includes one or more legs 72 sized to fit within the openings 99 in the bottom 98 of the outer housing 91. Each plug 71 also includes a pawl 73 that is biased outward to engage with one of the outer gears 93 of the contact member 39.

The functionality of this structure is similar to the structures described above for many of the embodiments. The structure may be positioned in various orientations to control the movement of the elongated member 100 in first and second directions. The locking member 30 is movable along the bottom 98 of the outer housing 91 and positionable in first, second, and third orientations. The elongated member 100 is able to move in the first direction in each of the orientations. The elongated member 100 is able to move in the second direction when the locking member 30 is moving from the first orientation to the second orientation, when moving from the second orientation to the third orientation, and in the third orientation. Movement of the elongated member 100 in the second direction is prevented in the second orientation.

Figure 24:
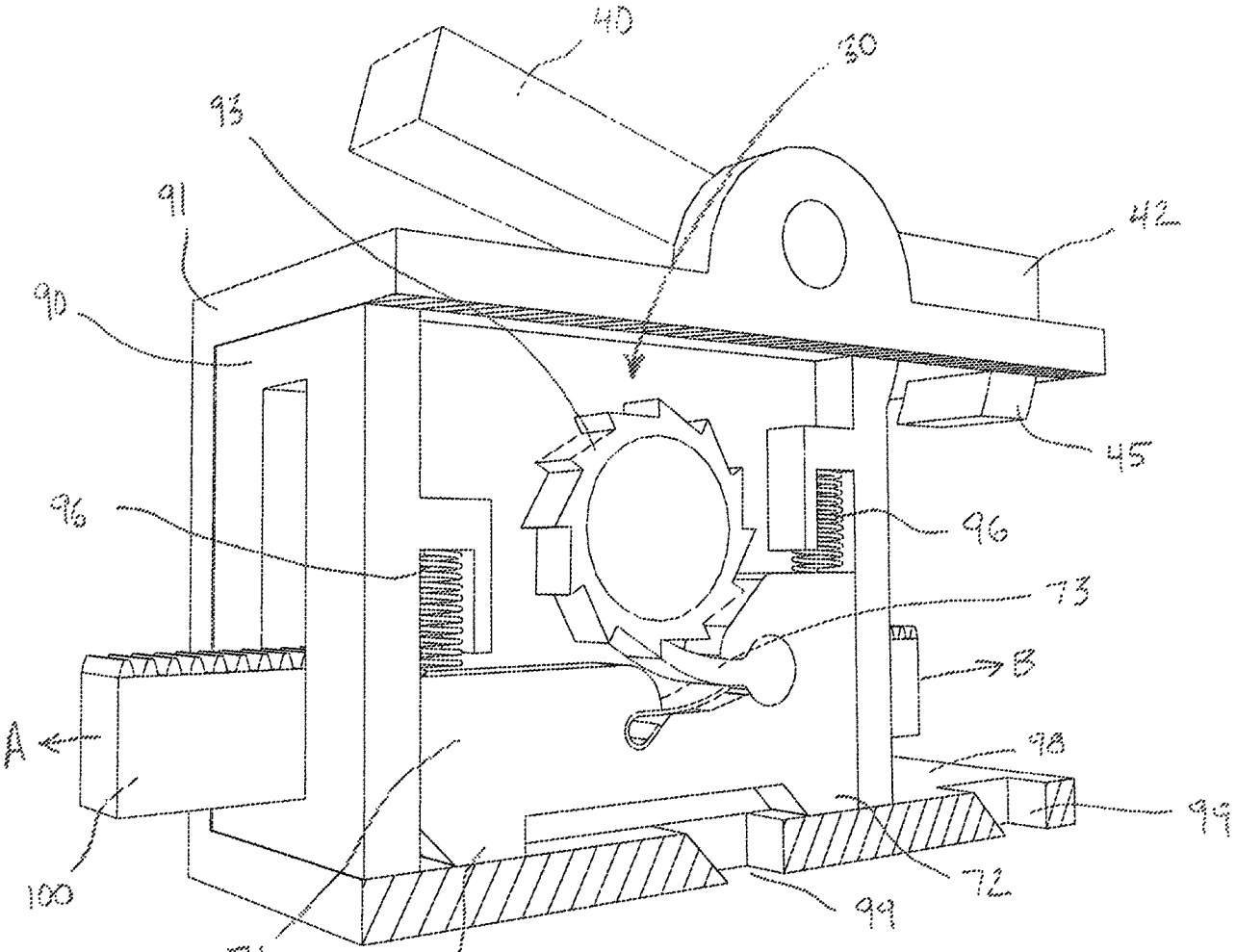
FIG. 24 is a perspective view of a first lateral side of an interior of the catch of FIG. 22 with the catch in a first orientation.
Figure 25:
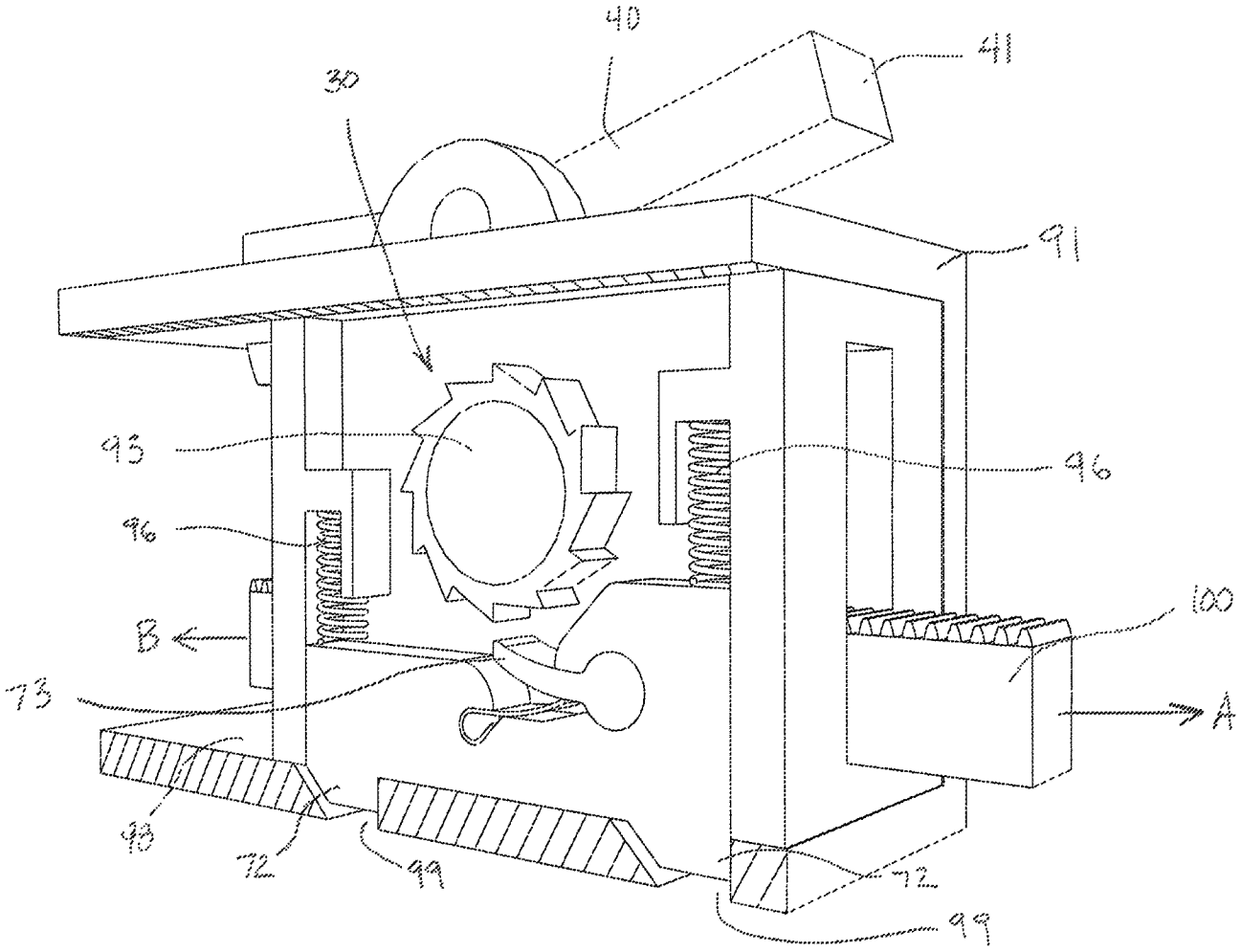
FIG. 25 is a perspective view of a second lateral side of an interior of the catch of FIG. 22 with the catch in a first orientation.

FIGS. 24 and 25 illustrate the catch 10 in a first orientation that allows for movement of the elongated member 100 in a first direction as indicated by arrow A. A limited amount of movement of the elongated member 100 in the second direction is allowed as the locking member 30 moves with the elongated member 100 from the first orientation to the second orientation. In the first orientation, the inner housing 90 is positioned with the legs 72 of the first plug 71 positioned away from the openings 99 in the bottom 98 of the outer body 91 (FIG. 24). As illustrated, a pair of biasing members 96 act on the top edge of the plug 71 and apply a downward force to the plug 71 to maintain its position against the bottom 98. The pawl 73 is biased into engagement with one of the teeth in the outer gear 93. The shape of the teeth of the outer gear 93 and the shape of the pawl 73 provide for the contact member 39 to rotate in a first direction. Movement in this direction allows for the elongated member 100 to move in the first direction indicated by arrow A. The shapes further prevent rotation of the contact member 39 in the opposing direction, thus preventing movement of the elongated member 100 relative to the locking member 30 in the direction of arrow B.

FIG. 25 illustrates the second lateral side of the catch 10 in the first orientation (i.e., the same orientation as FIG. 24). The legs 72 of the plug 71 are positioned in the openings 99 in the bottom 98 of the outer housing 91. The biasing members 96 acting on the plug 71 force the plug downward along the lateral side of the inner housing 90 with the legs 72 inserted in the respective openings 99. This downward positioning results in the pawl 73 being spaced away from the outer gear 93 of the contact member 39. Thus, this plug 71 has no effect on locking of the catch 10 on the elongated member 100.

The shapes of the legs 72 of the plugs 71 and the openings 99 in the bottom of the outer housing 91 also limit the extent of movement of the locking member 30. As illustrated in FIG. 25, the first sides of the legs 72 and the openings 99 are straight. This prevents the locking member 30 from sliding farther relative to the outer housing 91 in the direction indicated by arrow A. The second sides of the legs 72 and openings 99 include inclined surfaces that facilitate movement of the locking member 30 in the opposing direction. When the elongated member 100 is moved in the direction of arrow B, the locking member 30 moves with the elongated member 100. This movement causes the legs 72 on the second side to slide out of the openings 99. The extent of movement of the elongated member 100 in the direction of arrow B is limited to the inner housing 90 of the locking member 30 contacting against the tooth 45 in the second orientation.

Figure 26:
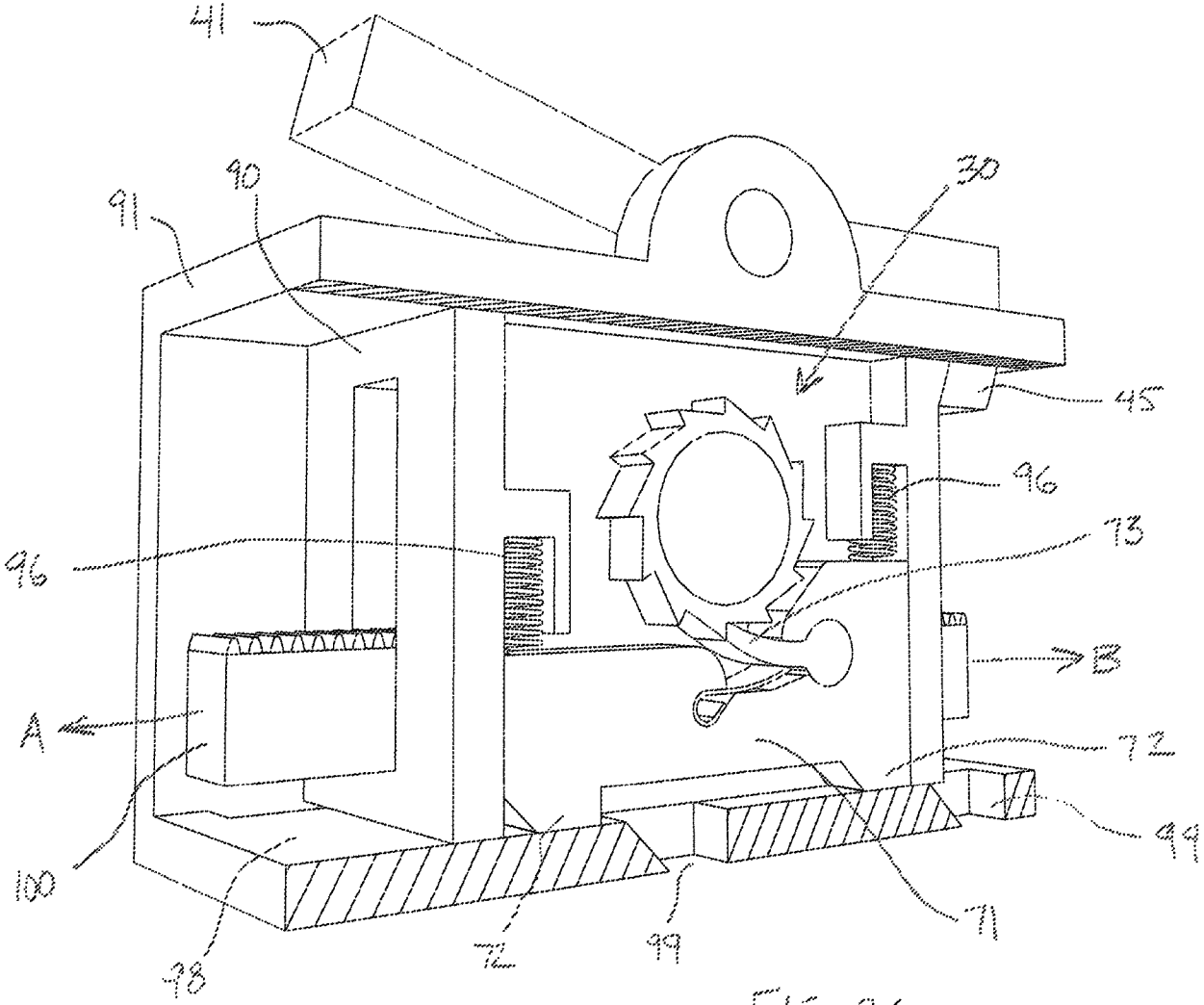
FIG. 26 is a perspective view of a first lateral side of an interior of the catch of FIG. 22 with the catch in a second orientation.
Figure 27:
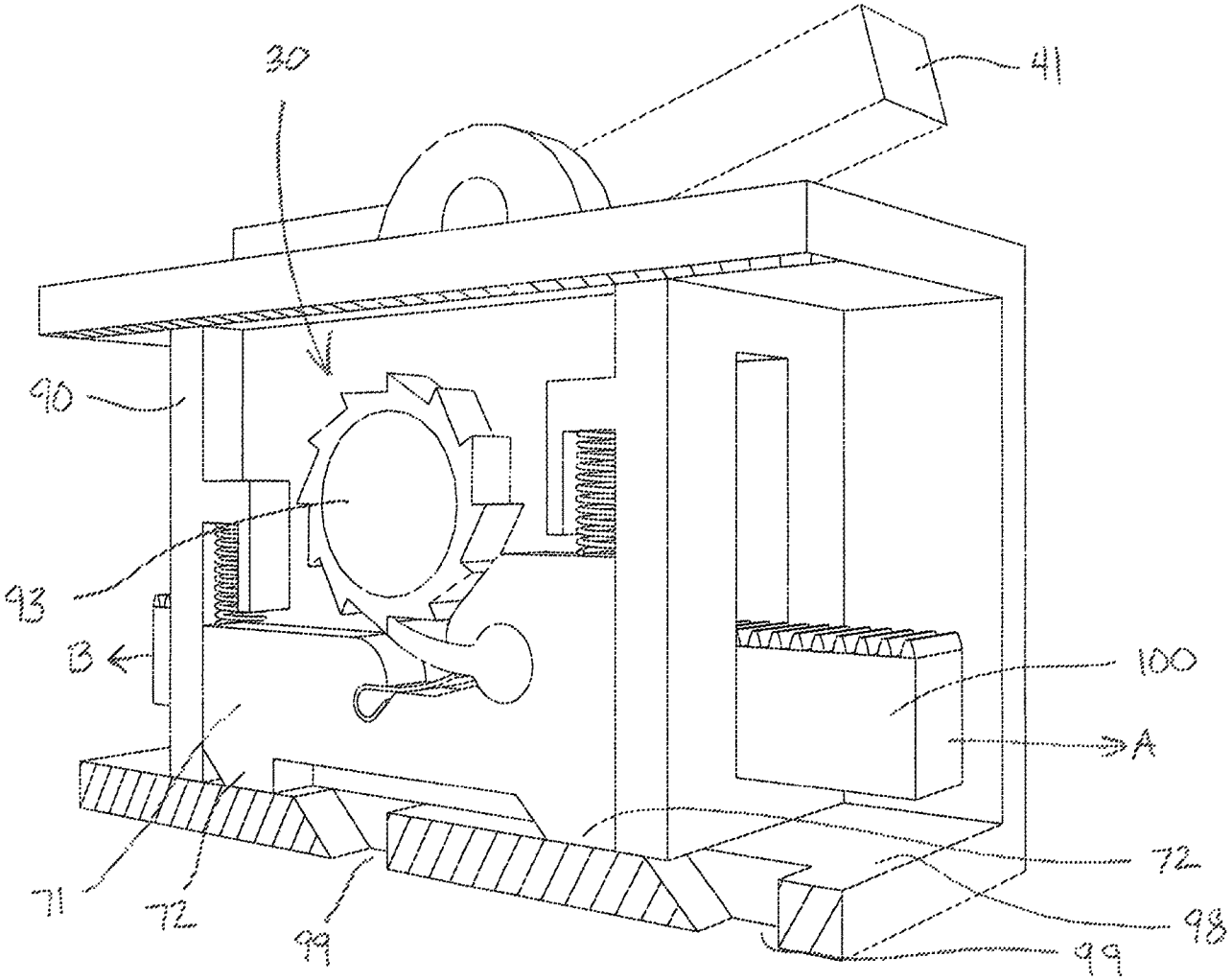
FIG. 27 is a perspective view of a second lateral side of an interior of the catch of FIG. 22 with the catch in a second orientation.

FIGS. 26 and 27 illustrate the catch 10 in a second orientation. In the second orientation, the elongated member 100 is prevented from moving relative to the locking member 30 in both the first and second directions A, B. Movement of the elongated member 100 relative to the outer housing 91 is only prevented in the direction of arrow B. Movement of the elongated member 100 relative to the outer housing 91 may occur in the direction of arrow A, which would also move the locking member 30 back towards the first orientation.

In moving from the first orientation to this second orientation, the locking member 30 has moved relative to the outer housing 91 in the direction indicated by arrow B. The extent of movement of the locking member 30 in this direction is limited by the contact of the inner housing 90 with the tooth 45 of the release member 40.

In the second orientation, each of the plugs 71 is positioned with its legs 72 away from the openings 99 in the bottom 98 of the outer housing 91. This upward position engages the pawl 73 on each plug 71 with the respective outer gear 93 of the contact member 39. The outer gears 93 each include teeth orientated in opposing directions. Thus the engagement of the pawl 73 with the outer gear 93 on the first lateral side as illustrated in FIG. 26 prevents movement of the elongated member 100 relative to the locking member 30 in the direction of arrow B. The engagement of the pawl 73 with the outer gear 93 on the second lateral side as illustrated in FIG. 27 prevents movement of the elongated member 100 relative to the locking member 30 in the direction of arrow A.

Figure 28:
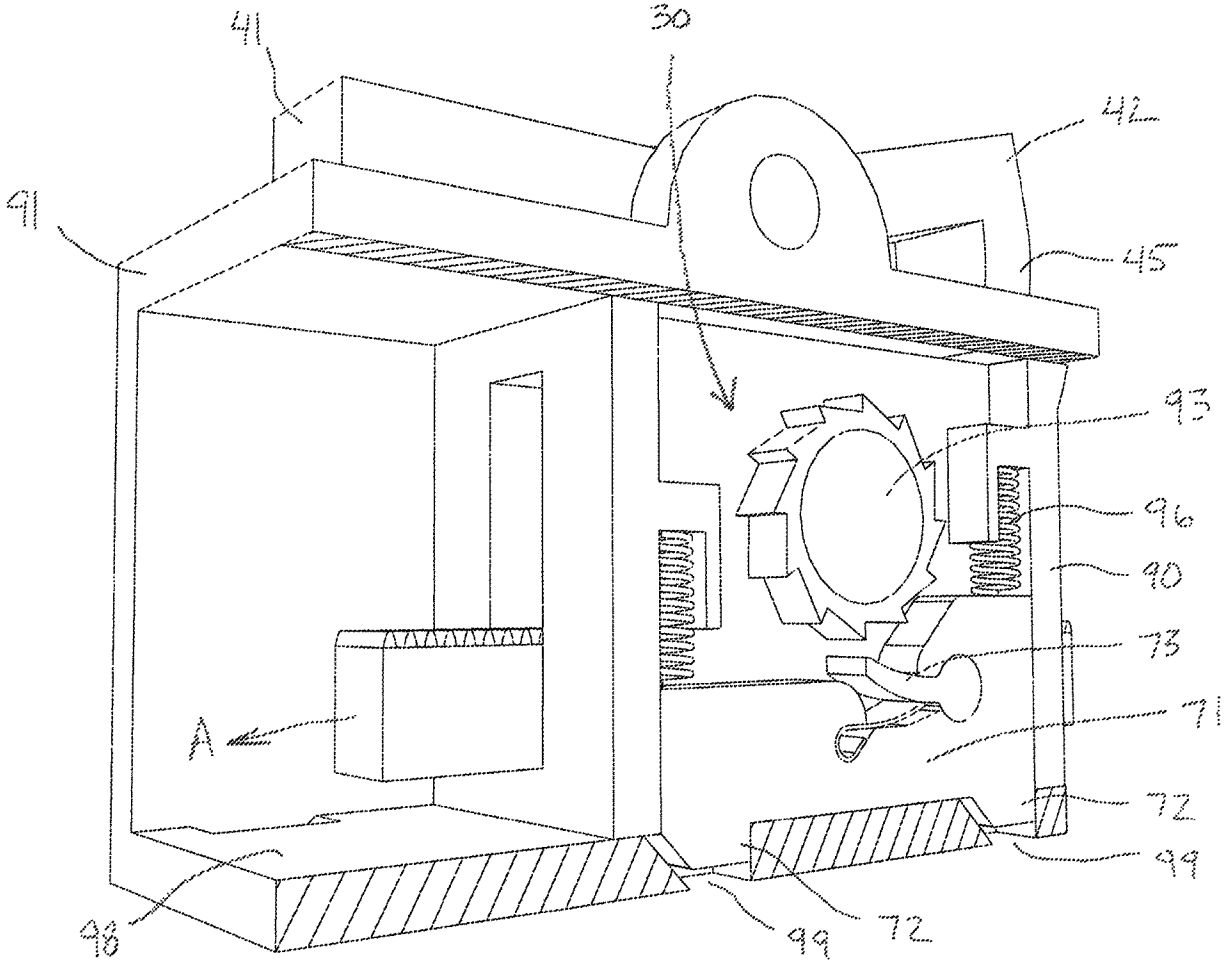
FIG. 28 is a perspective view of a first lateral side of an interior of the catch of FIG. 22 with the catch in a third orientation.
Figure 29:
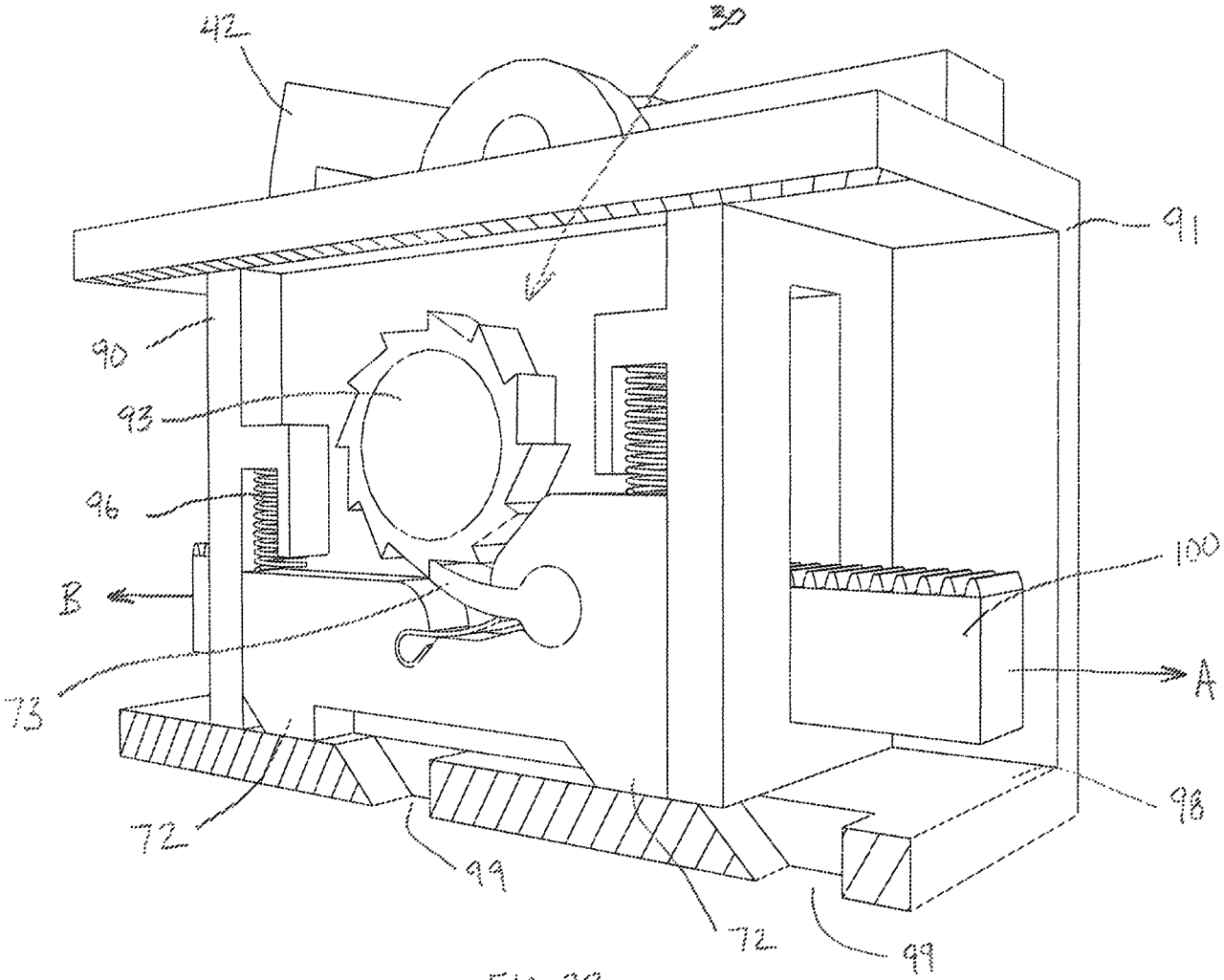
FIG. 29 is a perspective view of a second lateral side of an interior of the catch of FIG. 22 with the catch in the third orientation.

FIGS. 28 and 29 illustrate the catch 10 in a third orientation to allow movement of the elongated member 100 in the direction of arrow B and prevent movement of the elongated member 100 relative to the locking member 30 in the direction of arrow A. Movement of the catch 10 from the second orientation to the third orientation includes a user pivoting the release member 40 and applying a force to the elongated member 100 in the direction of arrow B.

As illustrated in FIG. 28, the first lateral side includes the legs 72 of the plug 71 positioned in the openings 99 in the bottom 98 of the outer housing 91. This downward positioning disengages the pawl 73 from the outer gear 93. The second lateral side as illustrated in FIG. 29 includes the legs 72 away from the openings 99 and contacting against the bottom 98 of the outer housing 91. This positioning engages the pawl 73 with the outer gear 93. The shape of the teeth of the outer gear 93 and the pawl 73 are configured to allow movement of the elongated member 100 in the direction of arrow B. This orientation also prevents the relative movement between the elongated member 100 and the locking member 30 in the direction of arrow A. Thus, moving the elongated member 100 in the direction of arrow A moves the locking member 30 back toward the first orientation. At the first orientation, the legs 72 on the second lateral side fall into the openings 99 thus preventing additional movement of the locking member 30 in the direction of arrow A.

In the third orientation, the extent of movement of the locking member 30 relative to the outer housing 91 in the direction of arrow B is controlled by the shape of the legs 72 and openings 99 on the first lateral side as illustrated in FIG. 28. Each of the legs 72 and openings 99 include straight sides that abut together to control an extent of movement in that direction. The opposing sides of the legs 72 and openings 99 are inclined such that the catch 10 can move from the third orientation back to the second and first orientations.

The middle gear 92 that contacts the elongated member 100 includes teeth that engage teeth 101 on the elongated member 100. This facilitates engagement and movement of the elongated member 100 through the catch 10. The catch 10 may also be used with elongated members 100 that do not include teeth 101 where the middle gear 92 is configured to contact against and move with the elongated member 100 due to the contact.

The various catches 10 may be configured to include one or more channels 21. Each of the channels 21 is configured to receive an elongated member 100. Further, the various channels 21 may include different shapes. In some embodiments, the channels 21 may be straight. Other embodiments may include the channels 21 having a curved shape. In embodiments with multiple channels 21, the channels 21 may have the same or different shapes.

In embodiments that accommodate multiple elongated members 100, the elements of the catch 10 that control the movement of the separate elongated members 100 may be the same or may be different.

The elongated member 100 may include various configurations, including deformable members such as but not limited to strings, cords, ropes, cables, chains, belts, bands, and straps. The member 100 may also be non-deformable such as but not limited to pipes, rods, poles, bars, beams, tracks, tape, wire, cables, chains, and planks. Some of these elongated members 100 may be constructed to be deformable or may be constructed to be non-deformable. In embodiments in which the elongated member 100 is deformable, the locking member 30 may or may not be non-deformable. Likewise, embodiments in which the elongated member 100 is non-deformable, the locking member 30 may or may not be deformable. This amount of deformation in some embodiments provides for the elongated member 100 to move through the catch 10 and still remain in contact with the locking member 30. The elongated members 100 may also be open-ended or closed-loop.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open-ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of controlling movement of an elongated member through a catch, the method comprising:

moving the elongated member through the catch along a channel in a first direction while a locking member that is in contact with the elongated member is maintained along the channel in a first orientation;

with the locking member in contact with the elongated member, moving the elongated member in an opposing second direction through the catch and simultaneously moving the locking member with the elongated member from the first orientation along the channel to a second orientation along the channel;

with the locking member in the second orientation, blocking the locking member with a release member and preventing the elongated member from moving farther along the channel in the second direction, the release member being in a first position;

moving the release member to a second position and moving the elongated member farther along the channel in the second direction and simultaneously moving the locking member that is in contact with the elongated member to a third orientation along the channel and over the release member;

maintaining the locking member in the third orientation and moving the elongated member farther along the channel in the second direction; and moving the elongated member in the first direction and simultaneously moving the locking member that is in contact with the elongated member along the channel from the third orientation to the first orientation.

2. The method of claim 1, further comprising contacting the locking member against a contact surface in the first orientation and preventing the locking member from moving farther along the channel in the first direction.

3. The method of claim 1, further comprising moving the locking member over the release member while the release member is in the second position while moving the locking member from the second orientation to the third orientation.

4. The method of claim 3, further comprising maintaining the locking member over the release member and preventing the release member from returning to the first position while the locking member is in the third orientation.

5. The method of claim 1, further comprising contacting the locking member against a contact surface in the third orientation and preventing the locking member from moving farther along the channel in the second direction while the elongated member is moving in the second direction.

6. A catch for controlling movement of an elongated member, the catch comprising:

a body with an interior space with a floor and a recess that extends below the floor;

a channel extending through the interior space along the floor and including a first side formed at least in part by a contact sidewall;

a locking member movably positioned in the interior space of the body, the locking member including a contact section that extends into the channel and a blocking section positioned away from the contact section;

a release member mounted in the body at the recess and selectively positionable between a first position with a contact portion above the floor and a second position with the contact portion below the floor;

a biasing member that biases the release member towards the first position;

the locking member movably positioned in the interior space between a first orientation at a first location along the channel with the blocking section spaced away from the release member, a second orientation at a second location along the channel with the blocking section of the locking member at the release member, and a third orientation at a third location along the channel with the blocking section positioned along the channel beyond the release member;

the release member being in the first position with the contact portion above the floor to contact the locking member when the locking member is in the second orientation and prevent movement of the locking member along the channel beyond the second orientation toward the third orientation, and positioned in the second position with the contact portion below the floor to allow movement of the locking member along the channel beyond the second orientation toward the third orientation of the locking member;

the contact section of the locking member being in closer proximity to the contact sidewall in the second orientation than in either the first orientation or the third orientation.

7. The catch of claim 6, wherein the locking member includes a triangular shape with the contact section comprising a tip.

8. The catch of claim 6, further comprising a contact edge positioned in the interior space above the floor, the locking member being in contact with the contact edge and moving along the contact edge when moving between the first, second, and third orientations.

9. The catch of claim 8, further comprising a post that extends upward beyond the floor of the interior space, the post positioned in proximity to the locking member to contact with the locking member in the first orientation and control an extent of movement of the locking member.

10. The catch of claim 6, wherein the channel is straight.

11. The catch of claim 6, wherein the channel includes a curved shape.

12. A catch for controlling movement of an elongated member, the catch comprising:

a body comprising a top and a bottom, the body comprising an interior space formed between the top and bottom with the interior space including a floor;

a channel extending through the body along the floor of the interior space, a first side of the channel being formed at least in part by a contact sidewall;

a travel path extending along the floor of the interior space in proximity to the channel, the travel path including a first end and an opposing second end;

a locking member positioned in the interior space at the travel path, the locking member including a contact section and being movable within the body along the travel path between the first and second ends;

a release member mounted in the body at the second end of the travel path, the release member comprising a first section with a first height and a second section with a greater second height;

the locking member being movable along the channel and opposite from the contact sidewall between a first orientation at the first end of the travel path with the contact section spaced a first distance away from the contact sidewall, a second orientation at the second end of the travel path with the contact section spaced a smaller second distance away from the contact sidewall, and a third orientation beyond the second end of the travel path and positioned over the first section of the release member, the third orientation including the contact section positioned a third distance away from the contact sidewall that is greater than the second distance.

13. The catch of claim 12, wherein the travel path includes a curved shape and is formed along a contact edge that extends upward beyond the floor of the body.

14. The catch of claim 13, wherein the release member includes a curved surface that is positioned at the second end of the travel path, the locking member moving along the curved surface when moving from the second orientation to the third orientation.

15. The catch of claim 13, wherein the locking member includes a curved contact side with a shape that matches the curved shape of the travel path.

16. The catch of claim 12, further comprising a biasing member that biases the release member towards a blocking position.

17. The catch of claim 12, wherein the locking member is in contact with a side of the first section of the release member in the second orientation.

* * * * *